US007819404B2

(12) United States Patent
Creech et al.

(10) Patent No.: US 7,819,404 B2
(45) Date of Patent: Oct. 26, 2010

(54) BOARD GAME WITH TOWER AND COLLAPSING STAIRS

(75) Inventors: William Creech, Springfield, MA (US); Daniel Sanfilippo, East Longmeadow, MA (US); Lee Lenkarski, Belchertown, MA (US); Andrew Lage, Belchertown, MA (US)

(73) Assignee: Hasbro, Inc., Pawtucket, RI (US)

( * ) Notice: Subject to any disclaimer, the term of this patent is extended or adjusted under 35 U.S.C. 154(b) by 77 days.

(21) Appl. No.: 12/188,858

(22) Filed: Aug. 8, 2008

(65) Prior Publication Data

US 2010/0032901 A1 Feb. 11, 2010

(51) Int. Cl.
*A63F 3/00* (2006.01)

(52) U.S. Cl. ..... 273/241; 273/287

(58) Field of Classification Search ..... 273/241, 273/287, 138.1, 139, 276
See application file for complete search history.

(56) References Cited

U.S. PATENT DOCUMENTS

| | | | | | |
|---|---|---|---|---|---|
| 3,369,811 | A * | 2/1968 | Glass et al. | ..... | 273/241 |
| 3,610,628 | A * | 10/1971 | Promin | ..... | 273/138.4 |
| 4,348,028 | A * | 9/1982 | Barlow | ..... | 273/249 |
| 5,169,153 | A * | 12/1992 | Levy et al. | ..... | 273/241 |
| 5,683,087 | A | 11/1997 | Henshaw et al. | | |
| 5,722,658 | A | 3/1998 | Talmage et al. | | |
| 5,951,010 | A | 9/1999 | Ordinas | | |
| 6,352,258 | B1 * | 3/2002 | Fitzgerald et al. | ..... | 273/138.1 |
| 6,446,968 | B1 | 9/2002 | Koch | | |
| 7,219,894 | B2 | 5/2007 | Stewart et al. | | |
| 2006/0091604 | A1 * | 5/2006 | Sargent | ..... | 273/241 |

* cited by examiner

*Primary Examiner*—Vishu K. Mendiratta
(74) *Attorney, Agent, or Firm*—Perry Hoffman

(57) ABSTRACT

An Indiana Jones theme board game having a tower supporting a plurality of collapsible stairs mounted in a spiral fashion, a deck of chance cards, dice, and pawns for the players. A tower top is mounted to the upper portion of the tower for rotation and downward vertical movement. A tube is mounted within the tower, and a number of pegs are mounted in the tower wall, one peg supporting a corresponding stair. The tube and pegs cooperate to transmit the rotational and vertical movement of the tower top to the collapsible stairs. The player picks a card and follows instructions printed on the card. During the game, certain cards instruct the players to rotate the tower top, causing openings in the outer wall of the tube to be located adjacent different combination of pegs, the combination being hidden and unknown to the players, such that the next vertical movement of the tower top and the tube results in an unknown combination of stairs to collapse. Certain stairs include hooks for engaging the pawns and preventing their fall should the stairs collapse. The tower also includes several small openings spaced from certain other stairs that allow pawns moved to particular spaces on those stairs to engage the tower to also ensure that the pawns do not fall should the stairs collapse.

12 Claims, 19 Drawing Sheets

164

162

168

166

172

170

BOARD GAME WITH TOWER AND COLLAPSING STAIRS

FIELD OF THE INVENTION

The present invention relates generally to a board game, and more particularly, to a board game of chance that includes a tower assembly with pivotal stairs that selectively collapse to cause players' pawns to fall from the tower.

BACKGROUND OF THE INVENTION

Board or table games are well known. Some of the more famous brands are household names, including the games MONOPOLY, RISK, CLUE, SORRY, BATTLESHIP and STRATEGO, all owned by Hasbro. Each of these games has provided fun and excitement for many years, and in some cases, several generations. New games are constantly being developed with the desire and hope of duplicating the popularity of the abovementioned classical games.

Several board games have been patented in the past. For example, a 1997 U.S. Pat. No. 5,683,087, issued to Henshaw et al., for "Apparatus And Method For Playing A Game" purports to disclose a game with a playing board having marked spaces along with game pieces to be moved based on the throw of a die where the object is to assemble a miniature house piece by piece, including a ground slab, walls, a ceiling and a chimney. The first player to build an entire structure wins. A Patent issued in 1998, U.S. Pat. No. 5,722,658 to Talmage et al., for a "Safety Board Game" purports to disclose a board game for teaching industrial safety rules based on moving playing pieces after successfully answering question cards. The following year, U.S. Pat. No. 5,951,010 issued to Ordinas for a "Table Game" with a board shaped like a truncated pyramid in the style of a Babylonian or ziggurat temple. The board is provided with steps of diminishing size indicating more difficult questions. The first player reaching the top wins. Another U.S. Pat. No. 6,446,968, issued to Koch for a "Themed Board Game" purports to disclose a board game depicting a number of locations and two identical sets of cards in which players vie with each other to solve a multi-part mystery by deducing which cards, randomly selected at the start, have no match. Another U.S. Pat. No. 7,219,894, issued to Stewart et al., relates to a board game in which players move pawns on a board and attempt to collect indicia-bearing tokens or markers to attach to player wearable costume components.

SUMMARY OF THE INVENTION

In accordance with the present invention, an advantageous game assembly is provided that is competitive, fun and has excellent play value. The present invention also provides an advantageous method for playing the game. The game is fast paced, intellectually stimulating and enjoyable. A preferred embodiment described below includes an apparatus that is robust, easy to use and relatively inexpensive, with a unique structure in which the game objective is to be the first to descend a series of stairs that selectively collapse from time to time in a sequence unknown to the players, and reach a specific board location.

Briefly summarized, the invention includes a game assembly having a base, an upstanding structure mounted to the base, a plurality of outwardly extending structures mounted to the upstanding structure, each of the outwardly extending structures being movable relative to the upstanding structure, a mechanism operator mounted to the upstanding structure for causing selective outwardly extending structures to move, a movable structure connecting the mechanism operator and the outwardly extending structures, a plurality of player pawns for selective movement along the outwardly extending structures, and chance structure for indicating how the player pawns are to be moved.

The invention also relates to a method for playing the board game including the steps of assigning a player pawn to each player of the game, mounting all player pawns on the upstanding structure with outwardly extending structures, the outwardly extending structures being movably connected to the upstanding structure, operating the chance structure sequentially by each player to determine the extent of movement of that player's pawn, and selectively operating a mechanism to selectively move the outwardly extending structures to cause unattached player pawns on the selected outwardly extending structures to fall from the outwardly extending structures.

The invention further relates to a game apparatus including a base, a tower mounted to the base, a vertically moveable tube mounted to the tower, a plurality of stairs movably connected to and extending away from the tower, and an operator structure mounted to the tower and in contact with the tube for moving the tube to cause selected stairs to pivot.

BRIEF DESCRIPTION OF THE DRAWINGS

For the purpose of facilitating an understanding of the invention, the accompanying drawings and description illustrate a preferred embodiment thereof, from which the invention, its structures, its construction and operation, its processes, and many related advantages may be readily understood and appreciated.

DETAILED DESCRIPTION OF THE EMBODIMENTS

Figure 1:
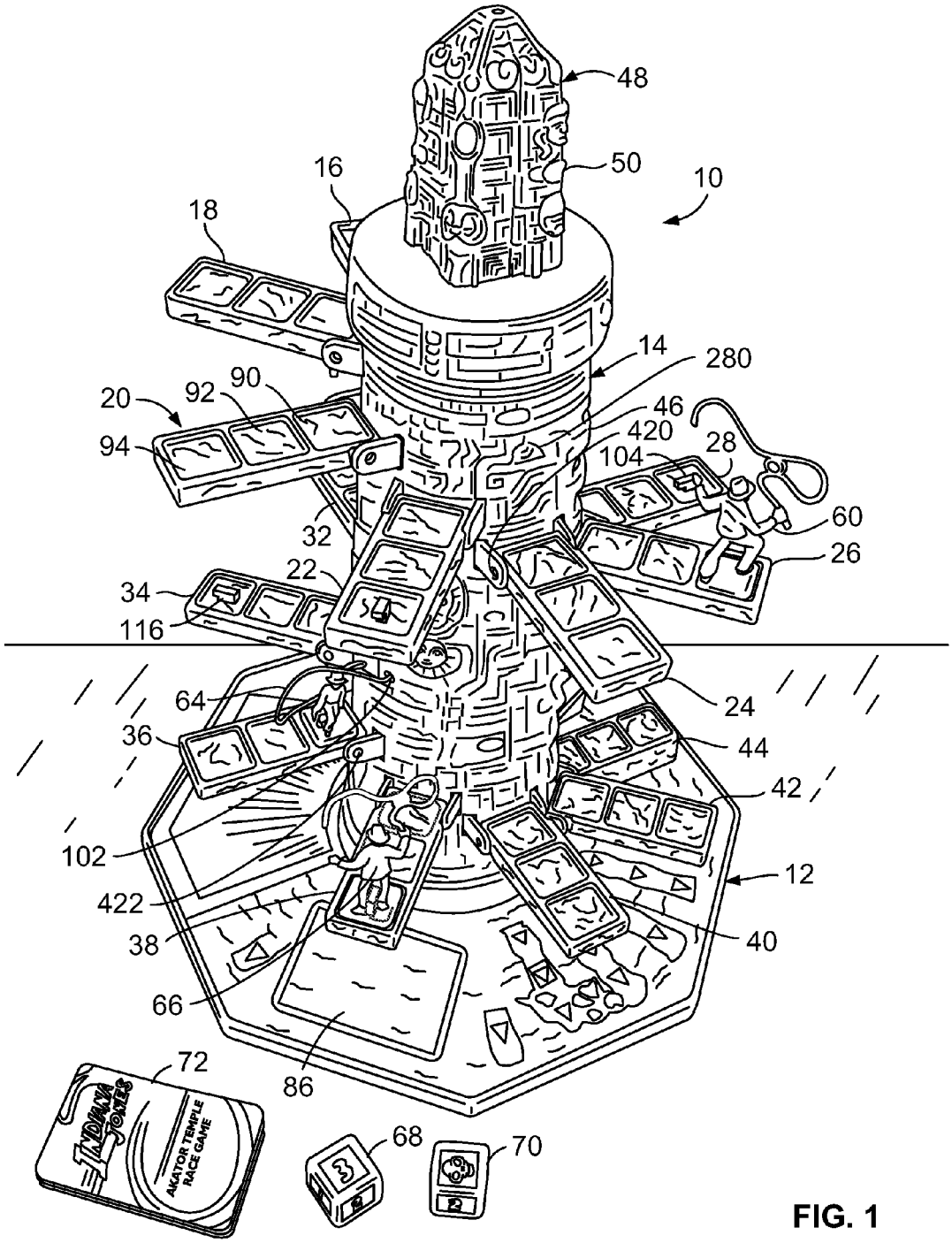
FIG. 1 is an isometric view of a preferred embodiment of the invention in the form of a board game assembly illustrating a tower apparatus, a base, several pawns, dice and a deck of cards.

The following description is provided to enable those skilled in the art to make and use the described embodiment set forth in the best mode contemplated for carrying out the invention. Various modifications, equivalents, variations, and alternatives, however, will be readily apparent to those skilled in the art. Any and all such modifications, variations, equivalents, and alternatives are intended to fall within the spirit and scope of the present invention as set forth in the appended claims.

A preferred embodiment of the present invention is a board game based on a movie released in 2008, "Indiana Jones and the Kingdom of the Crystal Skulls." The competitive, action-packed game features a plastic tower with collapsing stairs. Players must connect to the tower or to the stairs and avoid falling as players race down the tower to a winning location. The various elements of the board game assembly 10 are shown in FIGS. 1-4, and generally includes a base 12, an upstanding structure in the form of the tower 14 that is mounted to the base 12, and a plurality of outwardly extending structures, such as a starting platform 16, and thirteen selectively movable or collapsible stairs 18, 20, 22, 24, 26, 28, 30, 32, 34, 36, 38, 40 and 42. A lower stair 44 is fixed to the base 12. Each of the thirteen collapsible stairs is pivotally mounted around a wall 46 of the tower 14 in a descending spiral fashion starting with the stair 18. The game assembly 10 includes a mechanism operator or operator structure in the form of a rotatable and depressible tower top 48 mounted to the upper portion of the tower. The tower top 48 has an upside-down cup shape and an upstanding outer shaft 50 that is operated by a player to rotate and/or to move the tower top downwardly when the player is instructed. Rotation of the tower top 48 selects, without the knowledge of the players, which of the stairs will collapse or pivot downwardly, and thereafter, depressing the tower top causes the selected stairs to pivot. The object of the game is to descend the stairs and reach a designated space before any of the other players. The game is exciting and intellectually stimulating because selected stairs may collapse whenever a card instructs a player to depress the tower top. Also, during the game, certain cards instruct the players to rotate the tower top, causing openings in the outer wall of the tube to be located adjacent different combination of pegs, the combination being hidden and unknown to the players, such that the next vertical movement of the tower top and the tube results in an unknown combination of stairs to collapse. Any pawns on those stairs fall to the bottom of the tower and require the players whose pawns fell off to start over at the top of the tower. Certain stairs, however, include hooks for engaging the pawns and preventing their fall should the stairs collapse. The tower also includes several small openings spaced from certain other stairs that allow pawns moved to particular spaces on those stairs to engage the tower to also ensure that the pawns do not fall should the stairs collapse.

Figure 3:
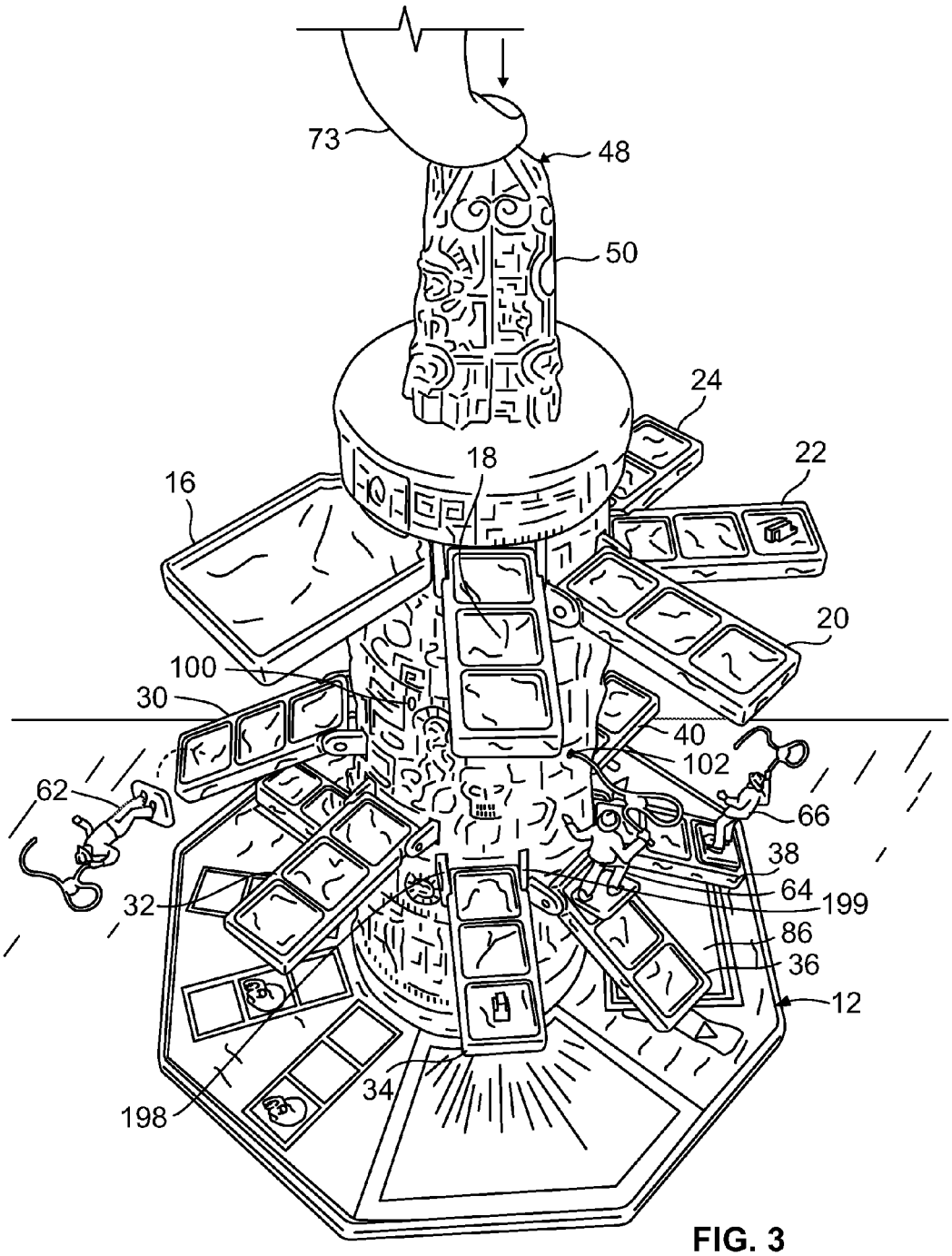
FIG. 3 is an isometric view of the tower apparatus of the game assembly shown in FIG. 1, but rotated about 240° and being operated by a player of the game assembly.
Figure 4:
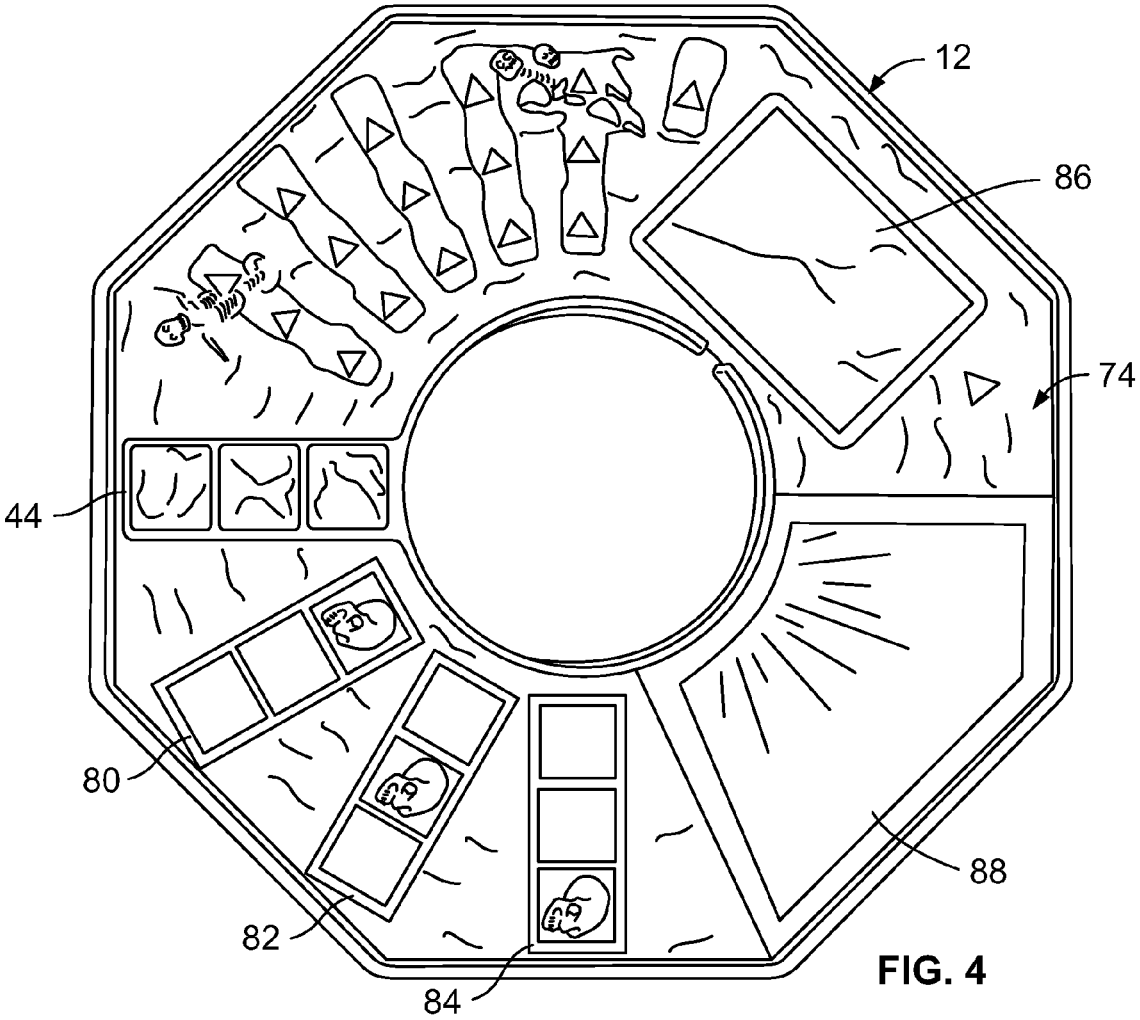
FIG. 4 is an enlarged top plan view of the base and a printed insert mounted on the base.

The game assembly 10 also includes a plurality of player pawns, and chance structure. The pawns are in the form of four small plastic figures 60, 62, 64, 66. Each pawn looks like the Indiana Jones character from the abovementioned movie, and is used by a player to move along the tower and the base. The board game is played using a three-part turn. First, a player throws one of the die, and second, the player moves his/her pawn in accordance with the number showing on the topside of the die. The chance structure comes in two forms, first, a pair of dice 68, 70, to indicate movements to be made by the pawns, and second, a deck of cards 72 for indicating what other movements of the pawns or other actions are to be taken. The depressible tower top 48 operates against a spring that biases a vertically movable structure in the form of a tube mounted inside of the tower and a plurality of horizontally slideable pegs mounted to the tower. When the tower top is depressed by a player 73, as illustrated in FIG. 3, the tube is moved downwardly. The moving tube acts as a cam against the pegs. The tube either bears against the pegs or not, in which case those pegs are no longer supported, slide inward and the corresponding stairs collapse. Using the tube and the pegs, the movement of the tower top is transmitted to the stairs in a manner that will be explained in more detail below in relation to FIGS. 12-19.

The base 12 includes a supported paper insert 74 printed with three game steps 80, 82, 84 similar in form to the stairs, a card deposit location 86, called the "Fallen Skull pile," for collecting specific kinds of cards, and a winner location 88 referred to as the "Throne Room Entrance." Each of the stairs and steps 18, 20, 22, 24, 26, 28, 30, 32, 34, 36, 38, 40, 42, 44, 80, 82, 84 is divided into three spaces, such as the stair 20, FIG. 1, having three spaces, an inner space 90, a middle space 92, and an outer space 94. The tower includes four openings, three openings 96, 98, 100, visible in FIG. 2, and a fourth opening 102 visible in FIG. 1, for receiving a part of the pawns whereby the pawns may be connected to the tower, as will also be explained in more detail below.

The pawns are moved down the stairs and along the steps from one space to a corresponding space and/or along spaces on the same stair or step. Four of the stairs 22, 28, 34, 38, each includes a protrusion in the outer space, such as a hook 104 on the stair 28, for engaging the Indiana Jones pawns. The tower openings 96, 98, 100, 102 are spaced relative to the stairs 26, 30, 32, 36 for allowing the pawns to engage the tower when on the inner spaces of those stairs. In both circumstances, pawns located on the outer spaces of the stairs 22, 28, 34, 38, and pawns located on the inner spaces of the stairs 26, 30, 32, 36 will be connected, respectively, to the stairs or to the tower, and when any of the stairs collapse, the connected pawns will not slide off as will other unconnected pawns.

Figure 2:
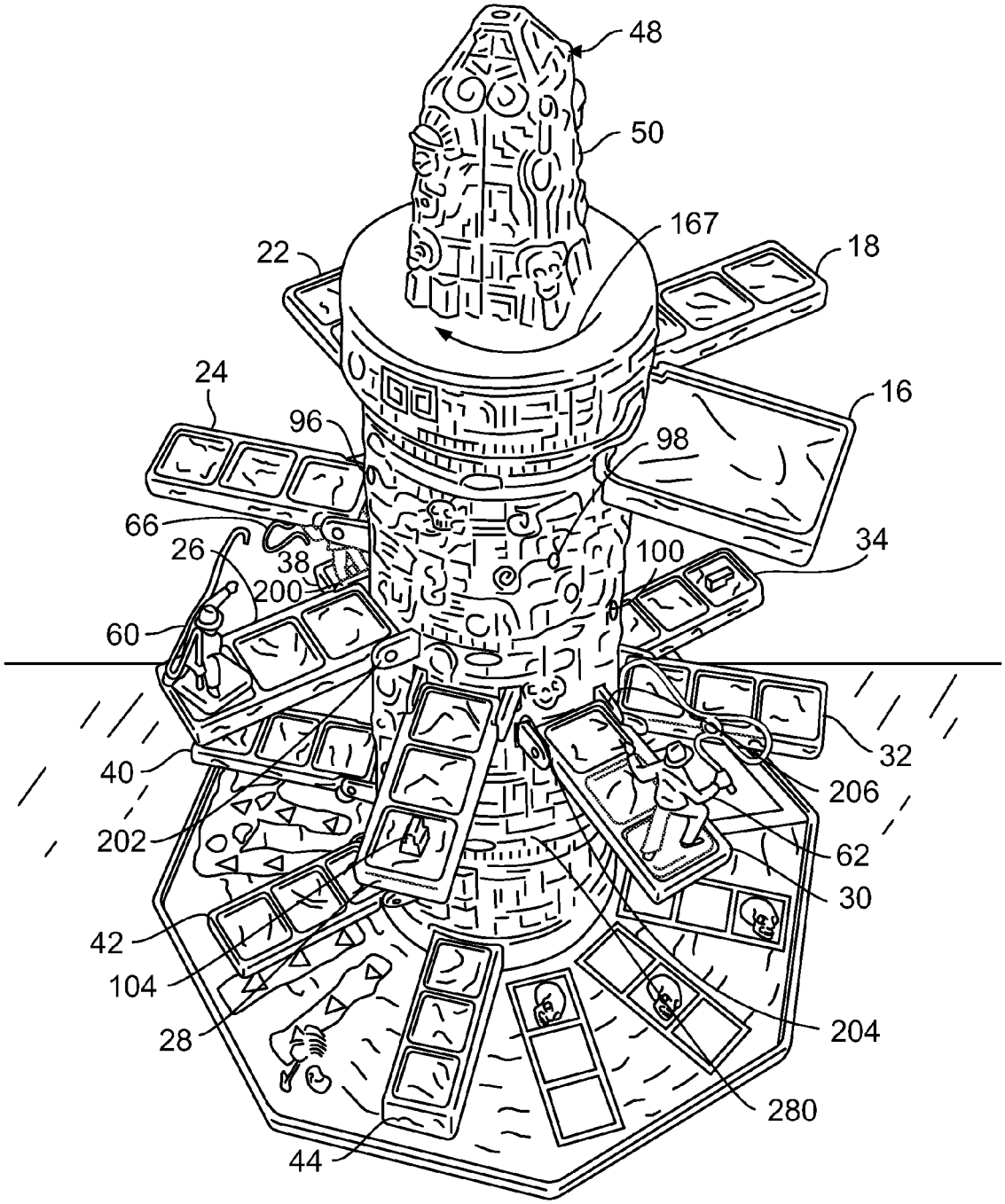
FIG. 2 is an isometric view of the tower apparatus of the game assembly shown in FIG. 1, but rotated about 120°.
Figure 18:
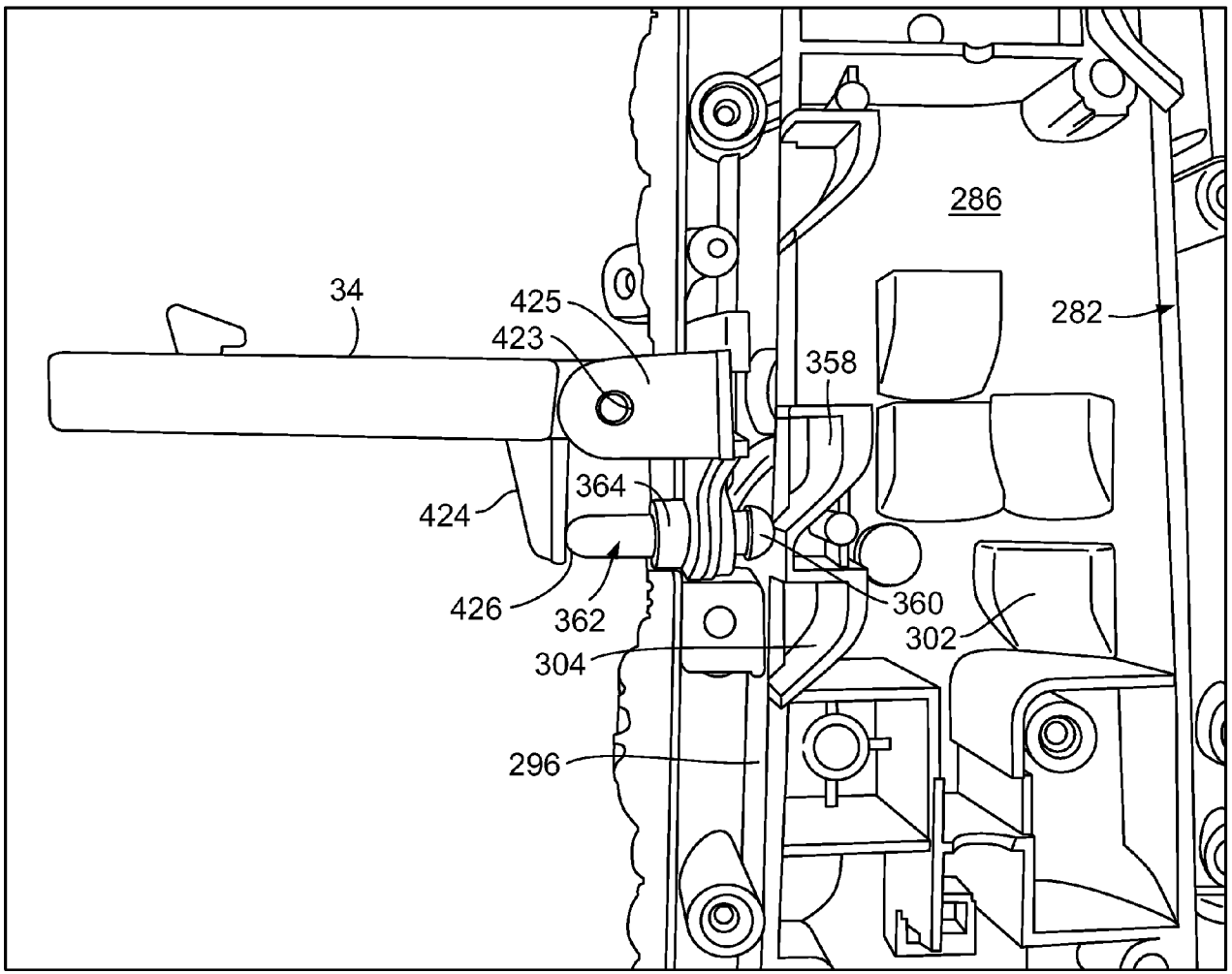
FIG. 18 is an enlarged, partial isometric view illustrating a peg supporting a stair.
Figure 19:
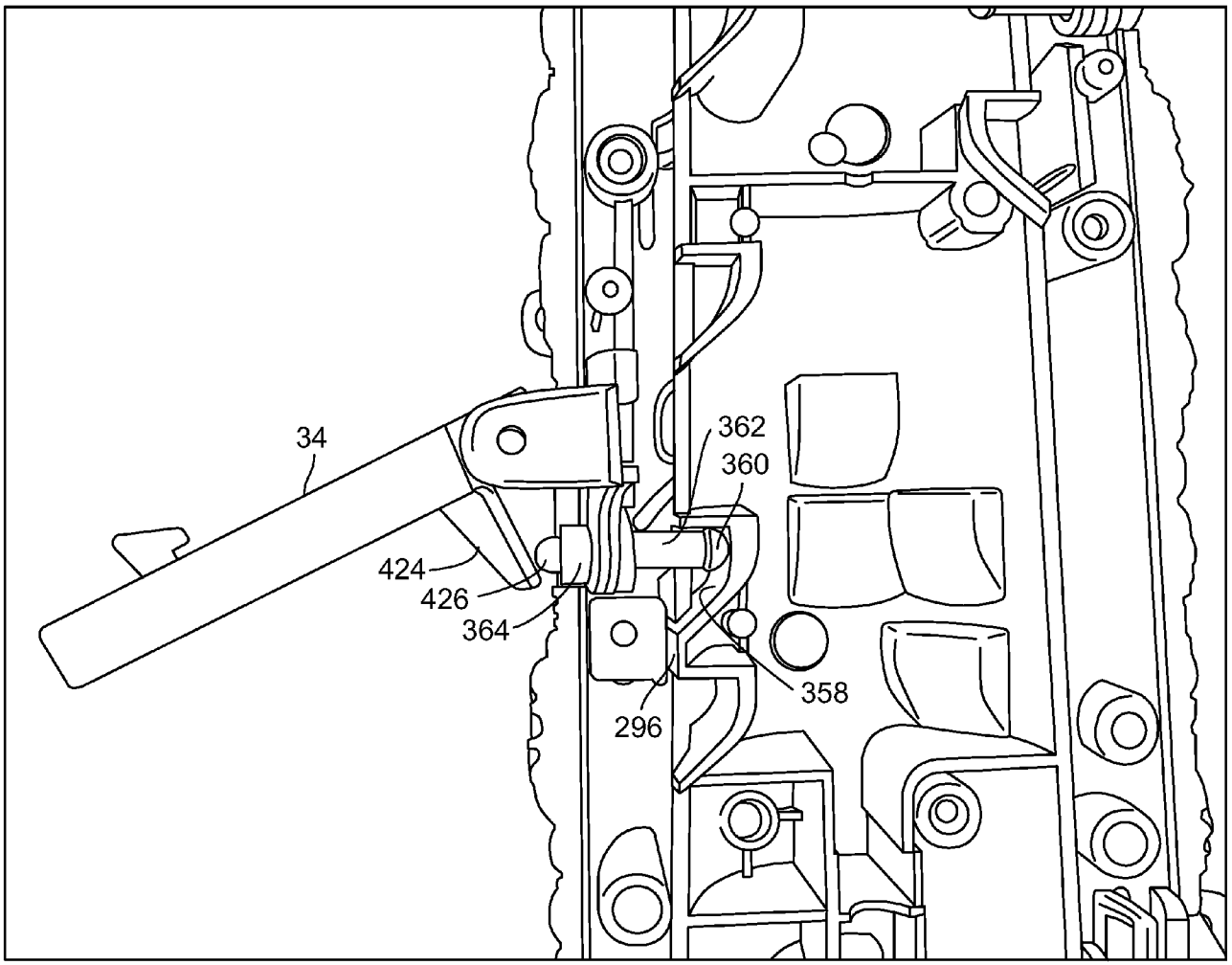
FIG. 19 is a view similar to that of FIG. 18 illustrating the peg in a retracted position and no longer supporting the stair, and the stair in a collapsed position.

The tower top 48 may be selectively rotated and depressed based on instructions received from the cards in the deck of cards 72. Depending upon the number of rotations, when the tower top is depressed, different combinations of stairs will pivot from a horizontal position, as shown in FIGS. 1, 2 and 18 to a downward, slanted position relative to the tower, as shown in FIGS. 3 and 19, at about a twenty-five degree angle, such that pawns not engaged to the stair hooks or to the tower, will slide off the collapsed stairs. Any player whose pawn has fallen off the stairs is required to start over again on the platform 16 connected to the upper portion of the tower.

Alternatively, instead of a tower, the upstanding structure may be a generally planar wall with pivotal stairs in a descending pattern and may be made by material other than plastic. Stairs may have less or more than three spaces, and the protrusions may be in other configurations than hooks. Different designs may be used for attachment of the pawns to the tower other than the openings in the tower. For example, Velcro brand fasteners or pressure sensitive glue or tape may be used to secure pawns. Also, the pawns may move from bottom to top of an upstanding structure such that a fallen pawn is conveniently located to start over at the bottom. Another alternative is for the stairs to retract into the wall to knock off any pawns.

Figure 5:
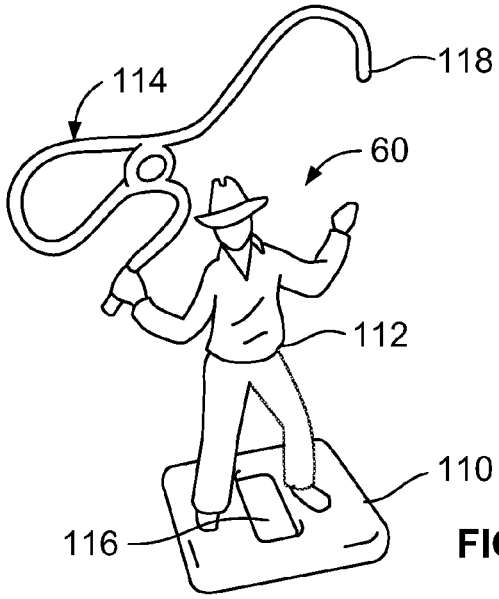
FIG. 5 is an enlarged isometric view of a pawn.

Each of the pawns, such the pawn 60, FIG. 5, includes a base 110, an action figure 112 integral with the base 110, with the action figure holding an integral extending element, such as a curved whip 114. The pawn base 110 includes an opening 116 for receiving the hooks of the stairs 22, 28, 34 and 38. When a hook 104 of a stair is received by a pawn opening 116, the integral Indiana Jones action figure will remain connected to that stair and will not slide off even when the stair is pivoted to the downward slanted position as is shown in FIG. 3 for several of the stairs. The curved whip 114 is configured with an end portion 118, such that an Indiana Jones pawn moved to an inner space of one of the stairs 26, 30, 32 or 36 enables the whip to reach into one of the tower openings 96, 98, 100 or 102, respectively, to connect the end portion 118 of the whip 114 with the tower. When connected, the Indiana Jones pawn will remain in position even after the stair on which the pawn has been placed pivots downwardly. Hence, it may now be understood that there are two ways that players may protect their pawns from falling when the stairs collapse, either land on an outer stair space with a hook, or land on an inner stair space adjacent to the tower that allows a whip end portion to be connected with the tower through a tower opening.

The Indiana Jones pawns are formed of plastic, but in the alternative, the pawns may be paper cutouts or have non-descript shapes. The pawns may also be configured differently. Furthermore, other themes may be used instead of the Indiana Jones character and pawns may be devised accordingly.

Figure 6:
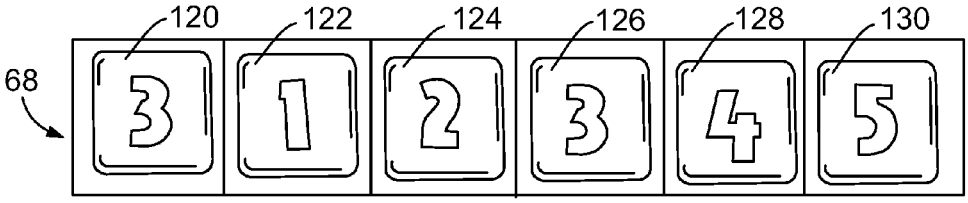
FIG. 6 is an enlarged plan view of one of the two dice in an unfolded, two-dimensional configuration.
Figure 7:
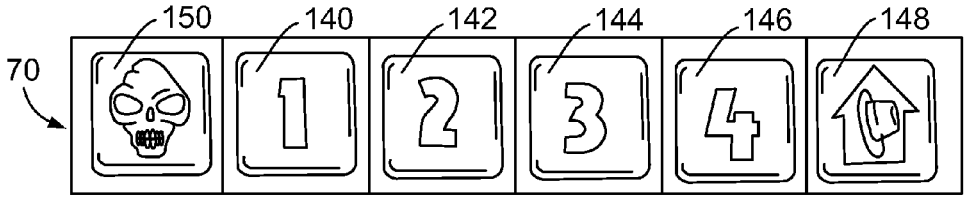
FIG. 7 is an enlarged plan view of the second of the two dice in an unfolded two-dimensional configuration.

In the preferred embodiment of the game assembly one of the dice, such as the die 68, FIG. 6, has six sides that are numbered, in particular, three 120, one 122, two 124, three 126, four 128 and five 130. The second die 70, FIG. 7, has six sides and are designated one 140, two 142, three 144 and four 146, "hat" 148 and "skull" 150. In the alternative, two spinners may be used instead of dice, or two sets of numbered cards.

Figure 8:
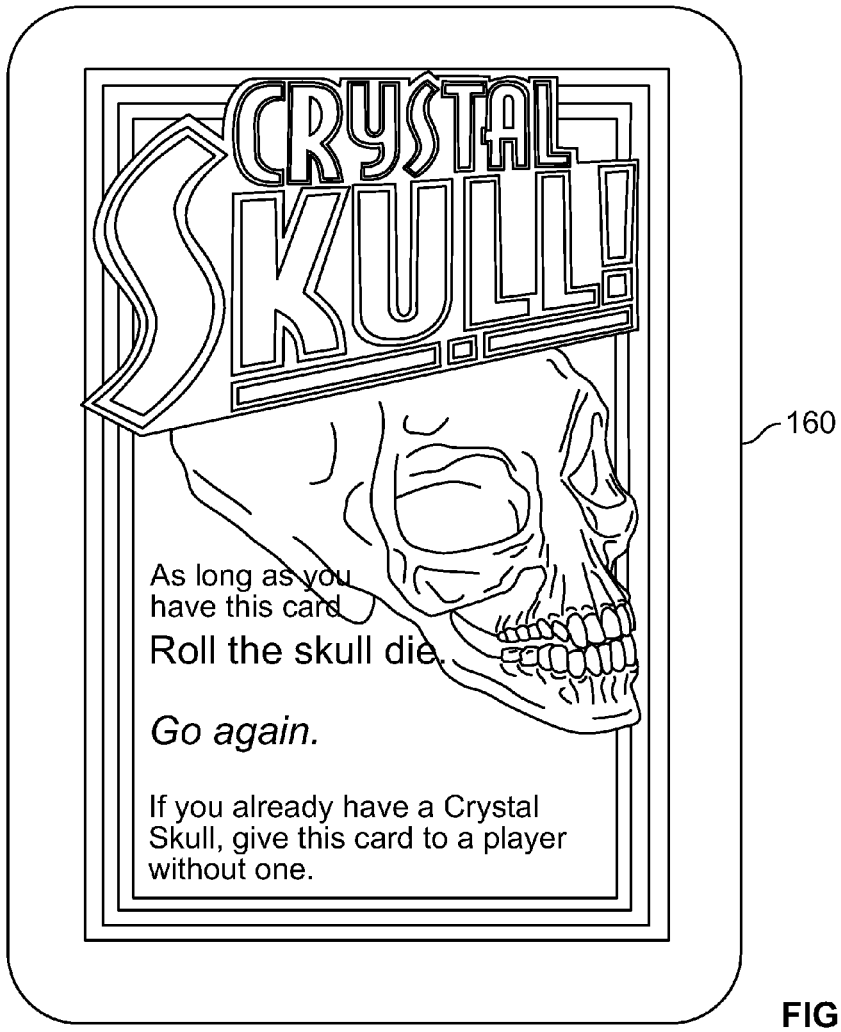
FIG. 8 is an enlarged plan view of a Skull card.

The deck of cards 72 includes, in the preferred embodiment, four different types of cards, several "Doom" cards, several "character" cards, several "Run" cards and several "Crystal Skull" cards. Every player starts play using the first die 68 to learn how far his/her pawn is to move. Once a player acquires a Crystal Skull card 160, FIG. 8, during play, that player uses the second die 70 to determine moves. To win, a player must reach the entrance to the Throne Room 88 before any other player while also possessing a Crystal Skull card 160.

Figure 9B:
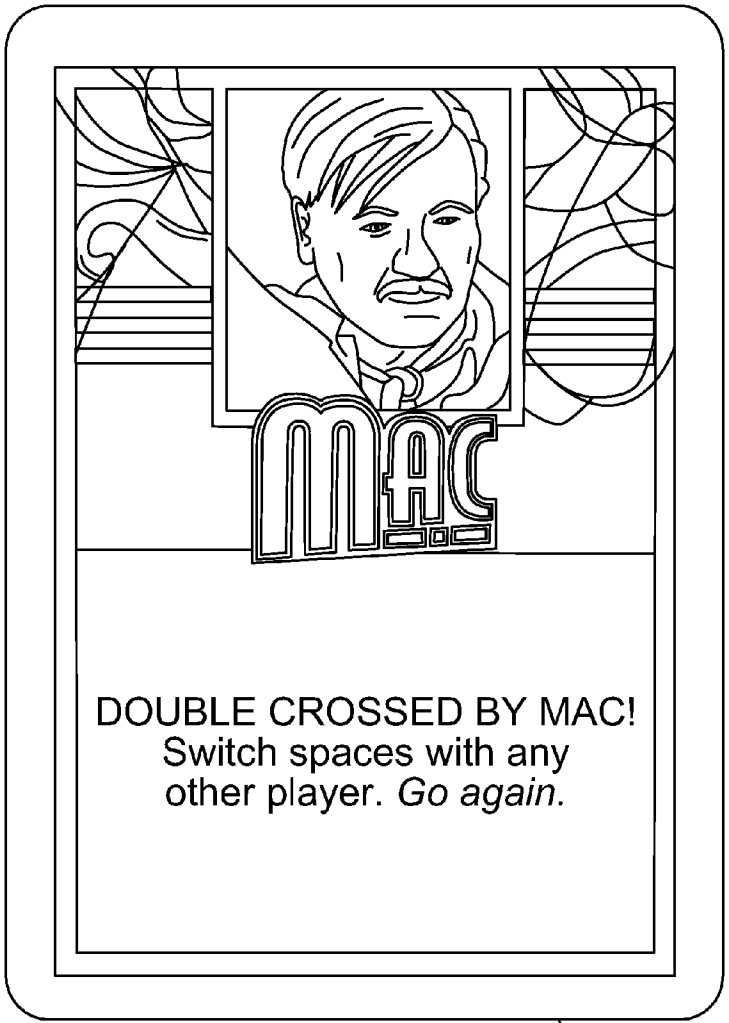
FIG. 9B is an enlarged plan view of a Mac character card.
Figure 9A:
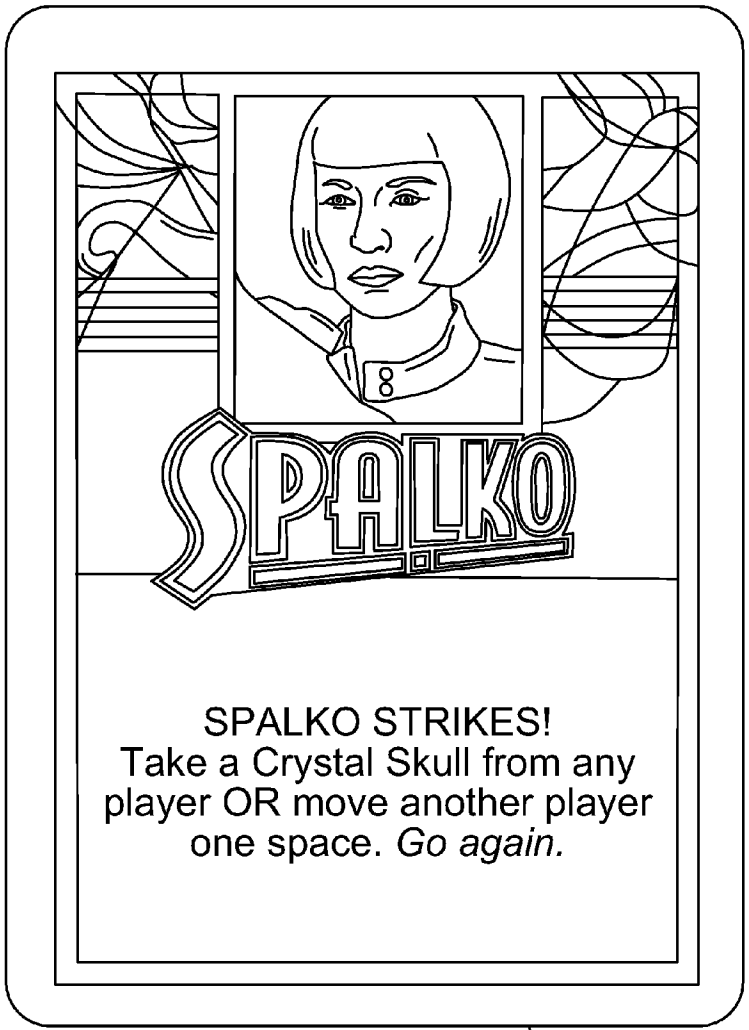
FIG. 9A is an enlarged plan view of a Spalko character card.
Figure 9D:
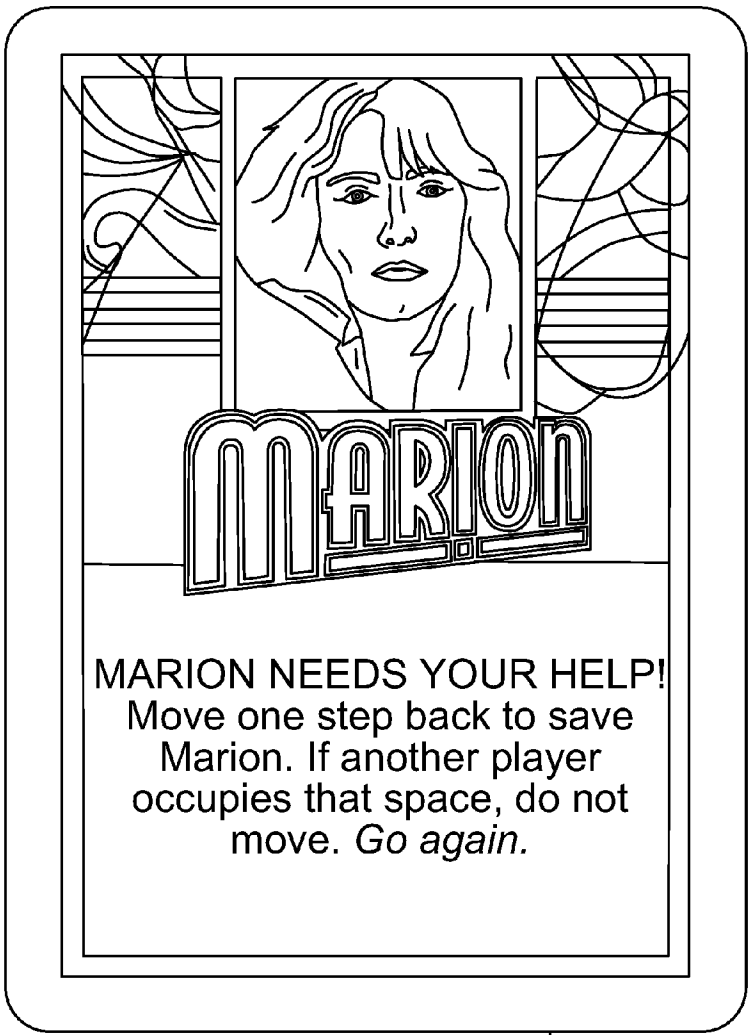
FIG. 9D is an enlarged plan view of a Marion character card.
Figure 9C:
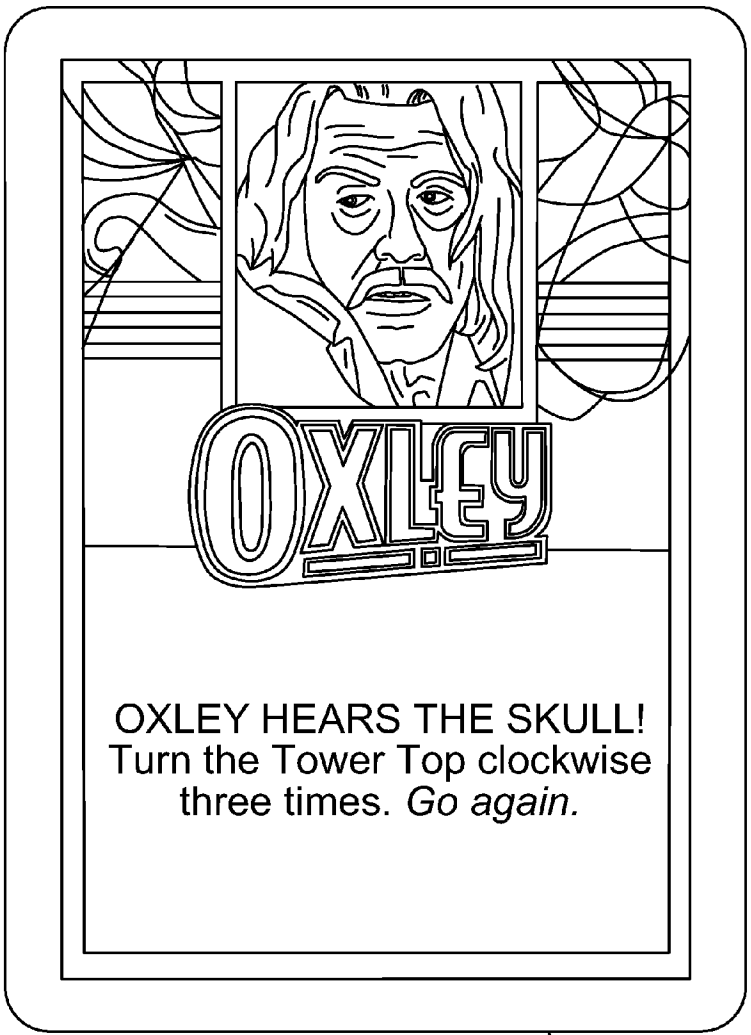
FIG. 9C is an enlarged plan view of an Oxley character card.
Figure 10:
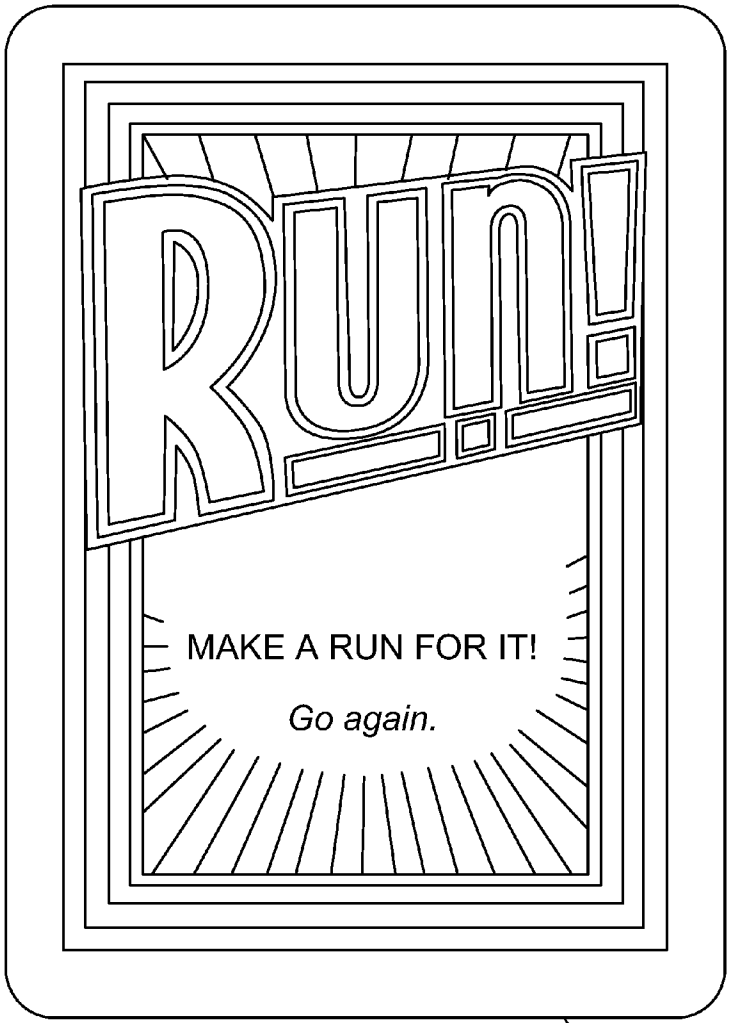
FIG. 10 is an enlarged plan view of a Run card.
Figure 9E:
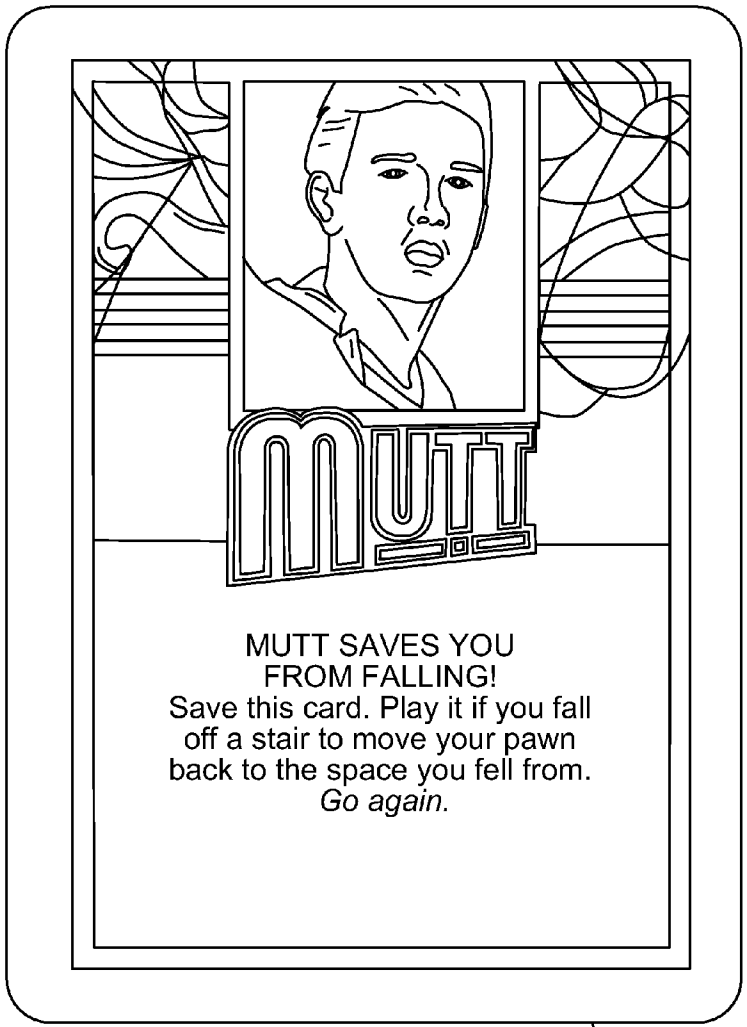
FIG. 9E is an enlarged plan view of a Mutt character card.
Figure 11B:
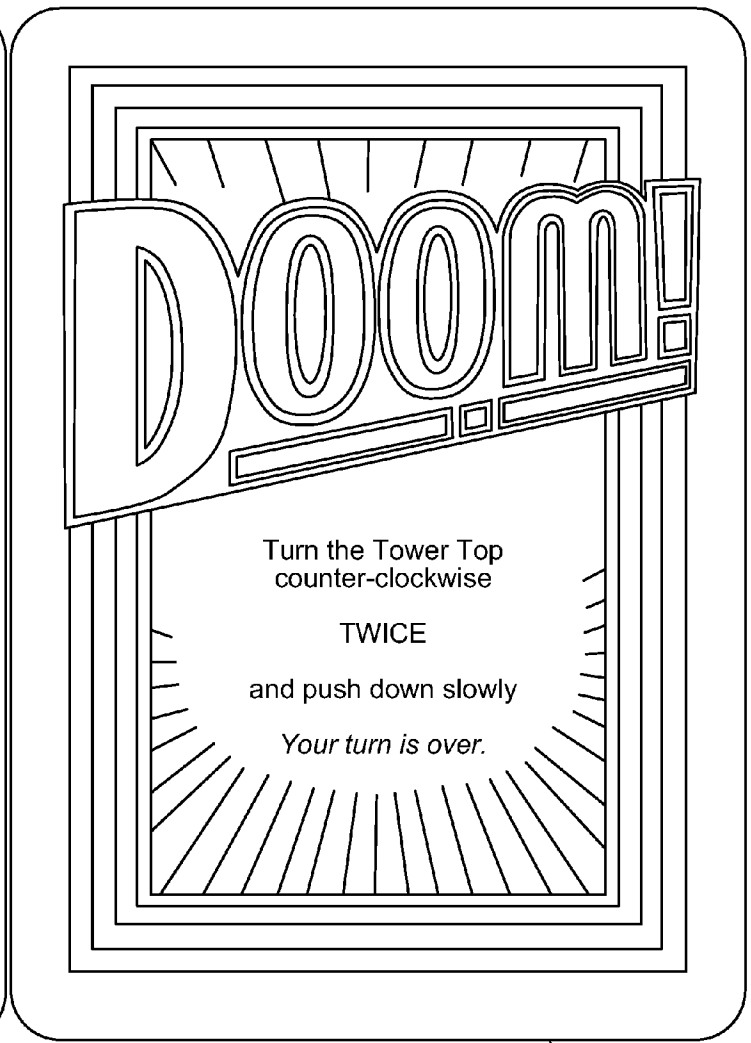
FIG. 11B is an enlarged plan view of a Doom-Twice card.
Figure 11A:
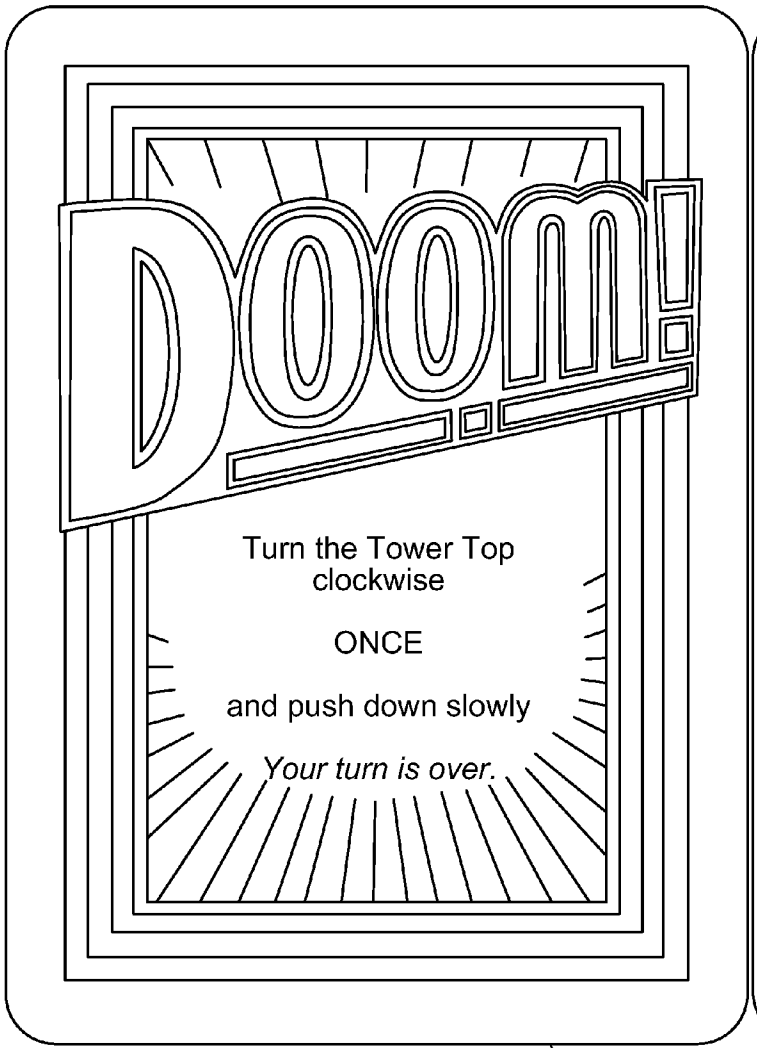
FIG. 11A is an enlarged plan view of a Doom-Once card.

There are four Crystal Skull cards in the deck, and eight character cards. The character cards include two "Spalko" cards 162, FIG. 9A, with each card stating that the receiver of the card must take a Crystal Skull card from any other player or move another player's pawn one space. In either circumstance, the player with the Spalko card throws the appropriate die again. One "Mac" card 164, FIG. 9B, allows the holder to switch places with another player and then throw the appropriate die again. Drawing an "Oxley" card 166, FIG. 9C, of which there is one, instructs the recipient to turn the tower top 48 clockwise three times (as shown by an arrow 167, FIG. 2) and throw the appropriate die again. There are two "Marion" cards 168, FIG. 9D, and these instruct the recipient to move one step back if another player does not occupy the space and then throw the appropriate die again. Two "Mutt" cards 170, FIG. 9E, instruct the receiver to save the card and play it, if the player falls off the stairs. The Mutt card allows the player to return his/her pawn to the stair space from which the pawn fell. The player then throws the appropriate die again. There are three "Run" cards 172, FIG. 10, each instructing the recipient to throw the appropriate movement die again. There are fifteen "Doom" cards. Ten Doom cards 174, FIG. 11A, instruct the recipient to turn the tower top 48 clockwise once and then depress the tower top. Depressing the tower top will pivot selected stairs, which are previously unknown to the players, and cause all of the Indiana Jones pawns on those stairs to fall unless they are connected to a hook or to the tower. Five Doom cards 176, FIG. 11B, instruct the recipient to turn the tower top counter-clockwise twice and then depress the tower top, again collapsing previously unknown selected stairs.

The board game in the preferred embodiment is played by having up to four players place their Indiana Jones pawns of different colors on the start platform 16 near the top of the tower 14. The first stair 18 of the fourteen descending stairs is adjacent to the platform and the remaining stairs are configured in a spiral fashion down to the three equal-level steps 80, 82, 84 printed on the base insert 74. Each player then has a three-part turn. The first part of each turn requires the roll of a chance structure, such as one of the dice 68, 70, the second part of the turn has the player moving his/her Indiana Jones pawn according to the die roll, and the third part of the turn requires the player to pick a card from the deck of cards 72 and follow the instruction on the card. During the first turn for each player, the die shown in FIG. 6 is used to indicate the number of spaces to move. After the move, a card is drawn to determine the player's next action or actions. Thereafter, the turn is over unless indicated differently by the card. Once a Skull card is drawn or otherwise received, that player rolls the Skull/hat die shown in FIG. 7, instead of the purely numbers die shown in FIG. 6.

Moving the pawn is generally downwardly along the stairs from one of the three spaces on each stair. Moving down from stair to stair the number of spaces rolled on the die is done directly, outer space to outer space, or middle space to middle space, or inner space to inner space, unless another player's pawn is on the same space, outer, middle or inner, on the next lower stair. In such a situation the moving player must move his/her pawn laterally along the three spaces of the upper stair until the corresponding space on the next lower stair is clear of another player's pawn. For example, if the pawn of the player who is to move five spaces is on the outer space of upper stair 20, a second player's pawn is on the outer space of the next lower stair 22, and the pawn of a third player is on the following lower stair 24 in the middle space, the moving player must use a first move to go to the middle space of the upper stair 20 to avoid the second player's pawn, before moving the pawn down to the middle space of the lower stair 22, a second move. Next, the player must make a third move to the inner space of the stair 22 to avoid the pawn of the third player on the stair 24. The moving player is then able to jump the pawn down, move four, to the inner space of the stair 24.

For the final move of the turn the player jumps the pawn downwardly to the inner space of the next lower stair 26.

The example illustrates that with a move of five spaces, the player's pawn is able to descend from the upper stair 20 to the lower stair 26 while evading pawns of other players. In addition, the stair 26 is a "safe" stair because the player connects the integral whip of the pawn to the tower so that if a follow-on player is instructed to depress the tower top, collapsing the stair 26, there is no effect on the first player's pawn.

As mentioned above, some of the cards of the deck of cards instruct a player to rotate the tower top a certain number of notches, and some other cards instruct a player to do both, turn the tower top a certain number of notches and then depress it. Depressing the tower top causes selected stairs to pivot and results in unattached pawns on those stairs falling off. A fallen pawn requires the corresponding player to start again on the platform 16 at the upper portion of the tower, unless the player has a Mutt card 170 that allows the player to return his/her pawn to the stair on which the pawn was situated before falling.

In certain stair locations, such as a stair having a hook on its outer space, or where the tower has an opening that can be reached by a pawn's whip when the pawn is on an inner space of a stair, pivoting of the stairs will not result in a pawn sliding off and falling. These stairs, therefore, have desirable spaces for those who can reach them before occupation by another player.

When a pawn has fallen, any Crystal Skull card 160 held by that player must be placed on the Fallen Skull pile location 86 on the base insert 74. Once a player reaches the bottom stair 44, he/she must move four more spaces (unless other player's pawns are present so as to require more than four moves) to reach the Throne Room Entrance location 88 and win, provided he/she possesses a Skull card.

It may now be appreciated that the board game 10 is competitive, intellectually stimulating, fast paced and fun.

Figure 12:
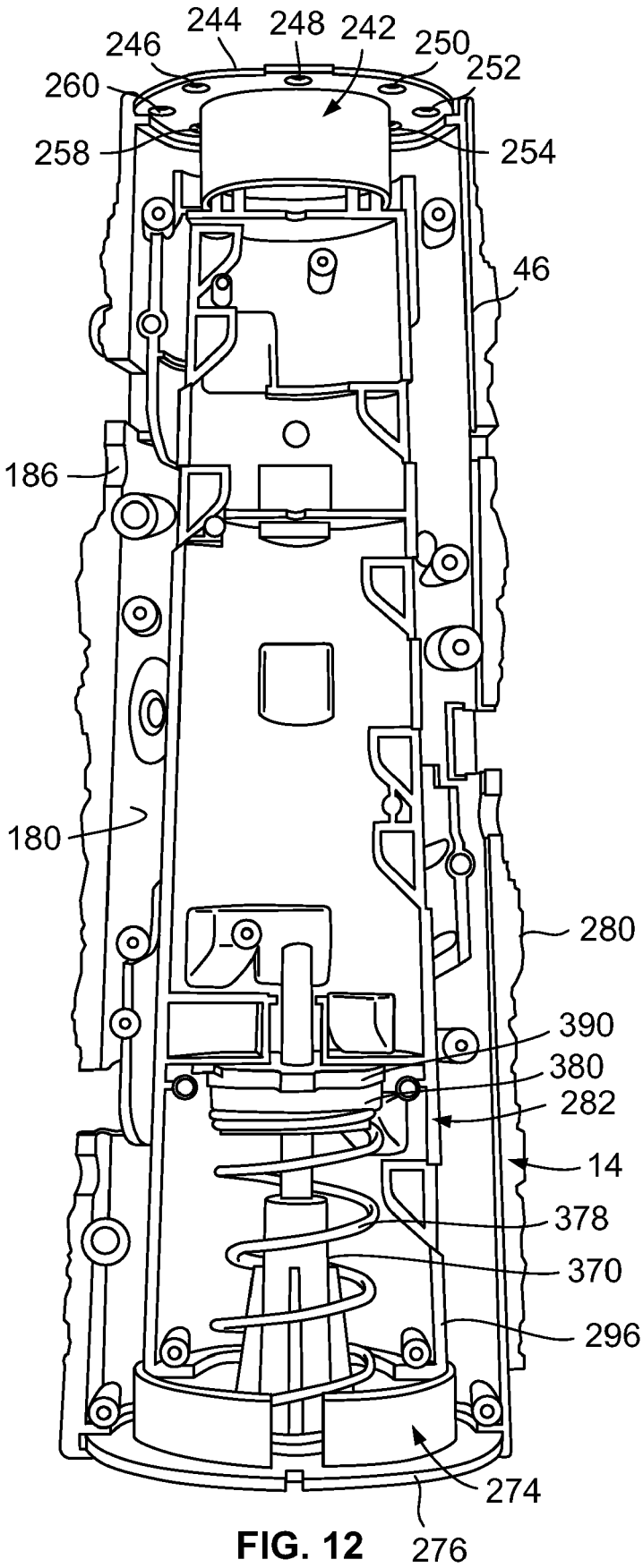
FIG. 12 is an isometric view of one-half of the tower and one-half of an internal tube but without brackets and pegs.
Figure 13:
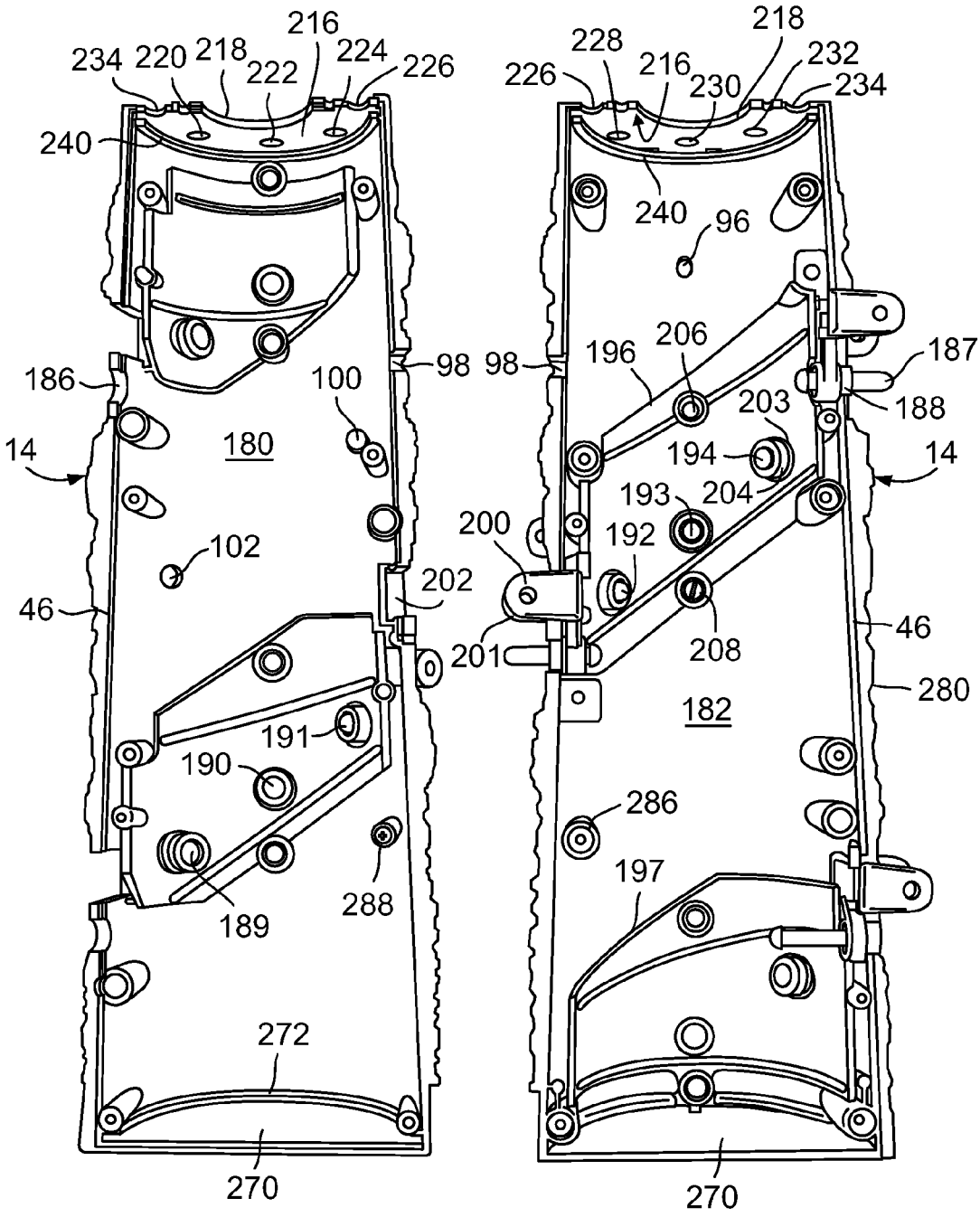
FIG. 13 is an isometric view of the inside of two tower halves.
Figure 14:
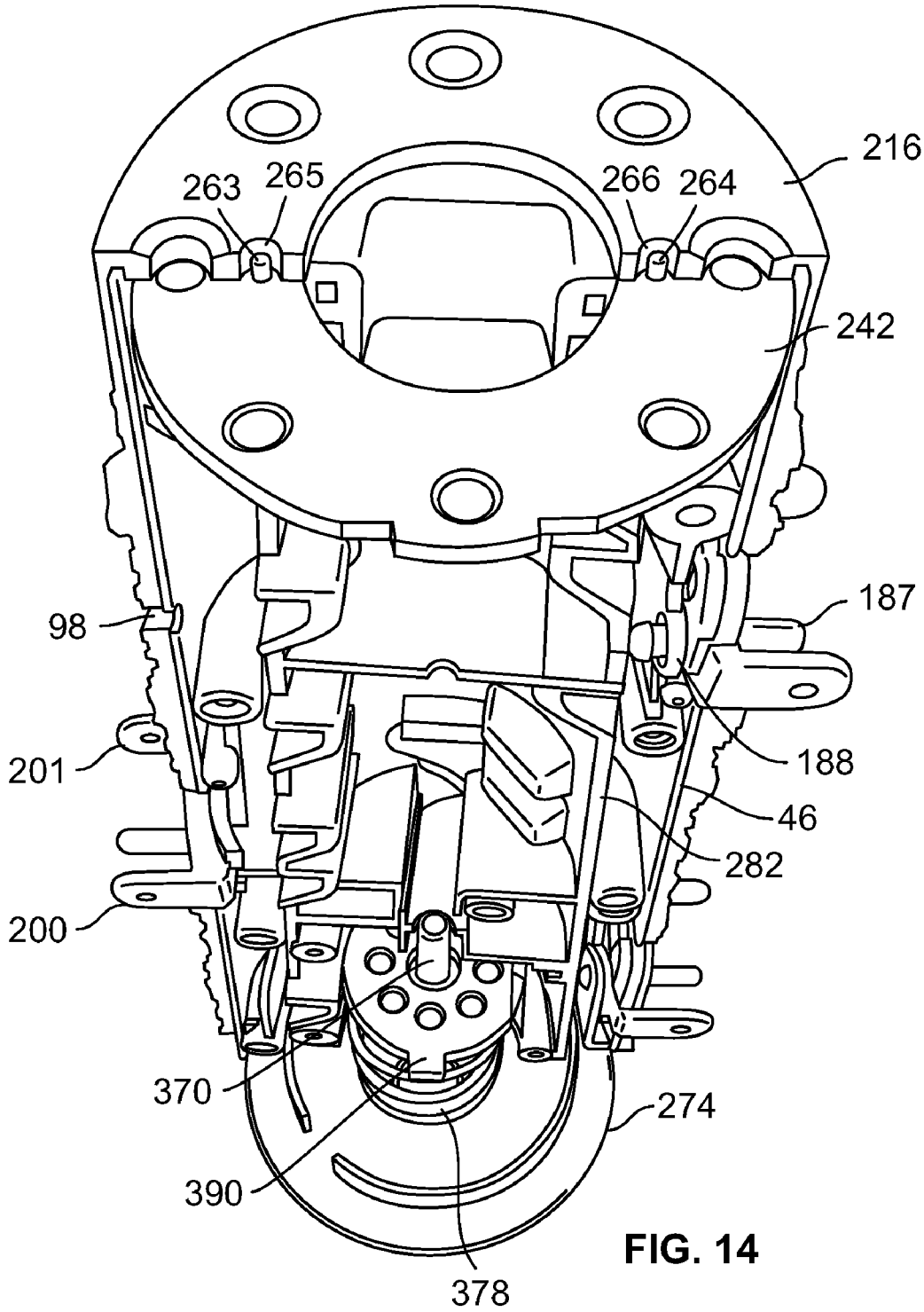
FIG. 14 is an isometric view of the tower half and the tube half.

The structure of the tower is illustrated in FIGS. 12, 13, and 14. The tower 14 is tubular in shape and is shown in two halves 180, 182 in FIG. 13, whereas only the tower half 180 is shown in FIGS. 12 and 14. The cylindrically shaped tower includes the small openings 96, 98, 100, 102 to receive the end portions 118 of the whips 114 of the pawns. The tower has slightly larger openings for bushings, such as the larger opening 186, FIG. 13, for a link in the form of a peg 187, slideable in a bushing 188. Additional links or pegs are present, for example, three pegs 189, 190, 191 in the tower half 180 and three pegs 192, 193, 194 in the tower half 182 are designated in FIG. 13. Curved plates, such the curved plates 196, 197, are fastened to the inside of the wall 46, for supporting the peg bushings, the pegs and bracket pairs extending through the wall, such as the bracket pair 198, 199, FIG. 3, supporting the stair 34. Other bracket pairs are supported by a curved plate and are also slotted into the wall 46, such as the bracket pair 200, 201, FIGS. 13 and 14, which supports the stair 30, FIG. 3. Slot-like openings in the wall 46, such as the slot-like opening 202, FIG. 13, are provided to support those other bracket pairs. The curved plates also have openings for the peg bushings, such as the plate opening 203, FIG. 13, for the peg 194 in the peg bushing 204. Fasteners, such as screws 206, 208, are used to connect the curved plates, such as the curved plate 196, to the tower wall. (It is noted that the drawings of FIGS. 13 and 14 include bracket pairs whereas the drawing of FIG. 12 does not.)

A top portion 216 of the tower is disk-shaped with a central hole 218 and a series of eight peripheral holes 220, 222, 224, 226, 228, 230, 232, 234. Beneath the top portion of the tower is a curved flange 240 to mount a top sleeve 242, FIG. 12 with an end flange 244 that also has eight holes 246, 248, 250, 250, 252, 254, 256, 258, 260 for alignment with the peripheral holes of the top portion 216 of the tower. The top sleeve also includes a larger central hole 262, FIG. 16, and is supported by the tower between the top portion 216 and the curved flange 240. Alignment pins 263, 264, FIG. 14, are integral with the upper sleeve 242 and engage openings 265, 266 in the top portion 216 of the tower to prevent rotation of the upper sleeve. (Note that the hole 256 of the end flange is hidden but is below the hole 230 in the top portion 216 of the tower.) Adjacent a bottom wall 270 of the tower is another curved flange 272 for mounting a bottom sleeve 274 with a flange 276 between the bottom wall 270 and the curved flange 272. The bottom sleeve is keyed to the tower to prevent rotation. An outer surface 280, FIGS. 1, 12 and 13, of the tower wall 46 may have an appropriate design in keeping with the theme of the board game.

Figure 15:
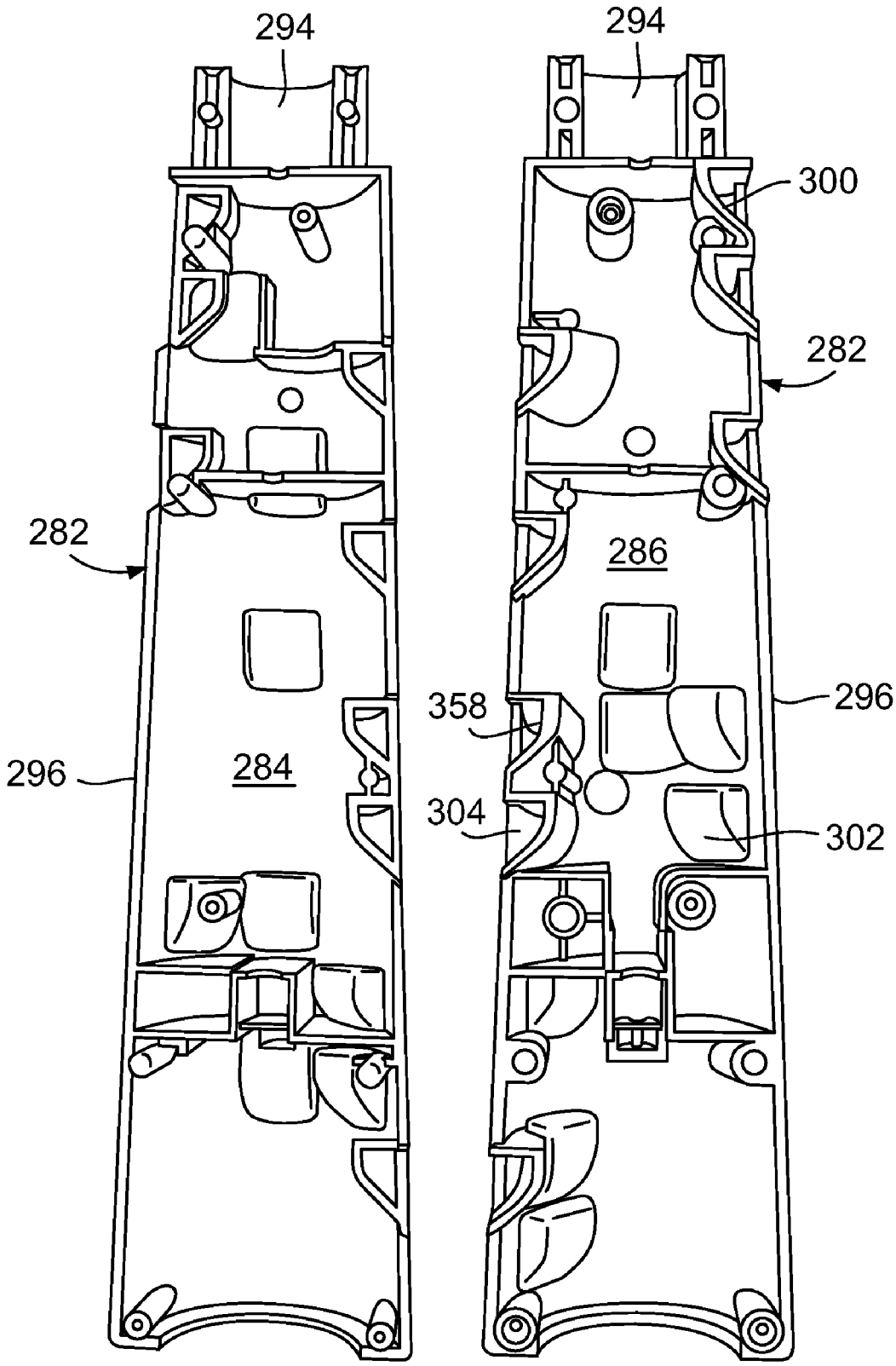
FIG. 15 is an isometric view of the inside of two tube halves.
Figure 16:
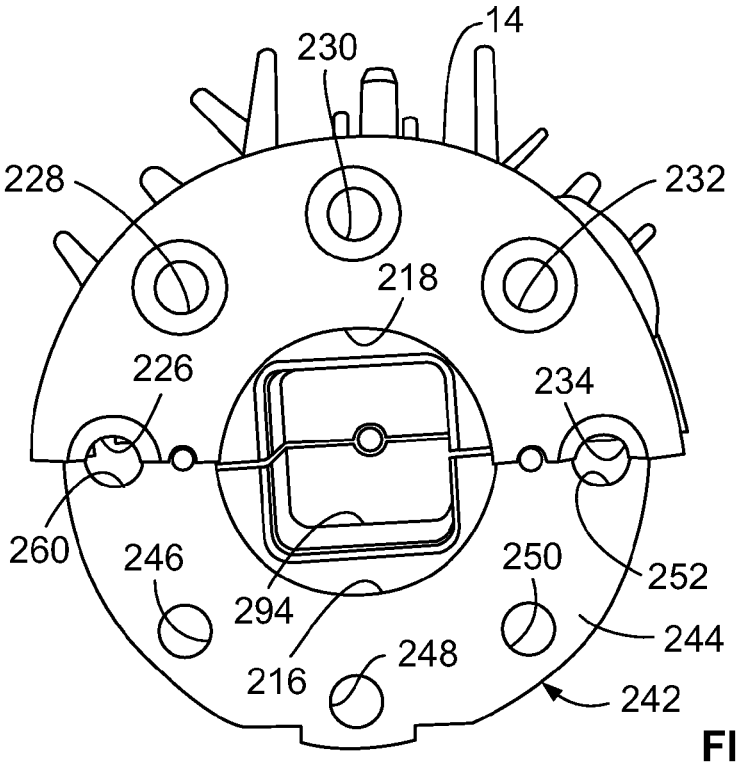
FIG. 16 is a plan view of the tower and tube shown in FIG. 14.
Figure 17:
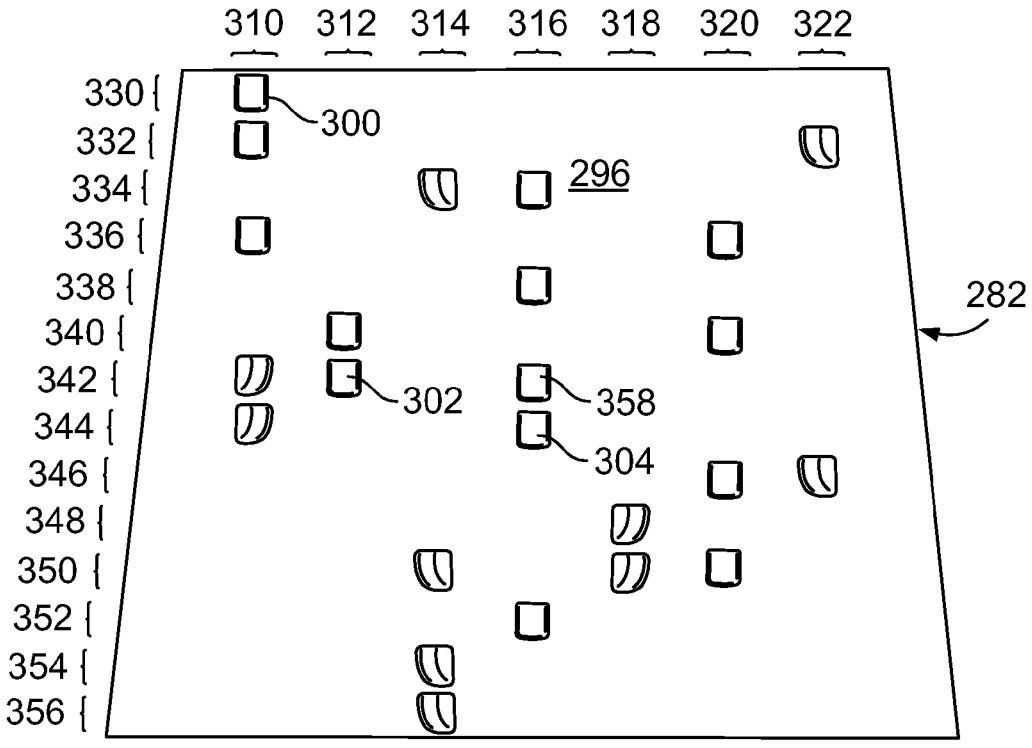
FIG. 17 is a plan view of the outer surface of the tube shown in FIG. 15, in a two dimensional configuration.

Mounted to the top and bottom sleeves 242, 274 within the tower 14 is part of a movable structure in the form of an internal tube 282, FIG. 15. The tube is molded of a suitable plastic in two halves 284, 286. The tube and the pegs form the movable structure as will be explained below, and they are part of the game assembly 10. The tube 282 includes a square shaped opening 294 at its upper end as best seen in FIG. 16, and an outer surface 296, best seen in FIG. 17, where the outer surface of the cylindrical tube is depicted unrolled and in two dimensions. The tube is configured with specific outer diameters because of a slight taper, and includes twenty-four circumferential openings, such as the openings 300, 302 and 304, for example. The tube openings are arranged in seven columns 310, 312, 314, 316, 318, 320, 322 and fourteen rows 330, 332, 334, 336, 338, 340, 342, 344, 346, 348, 350, 352, 354, 356 and are arranged to interact with the pegs. The tube 282 is mounted to be both rotatable, and axially movable, so that either the outer surface 296 of the tube or a tube opening, such as the opening 358, is positioned adjacent the inner end of a peg, such as the inner end 360, FIGS. 18 and 19 of the peg 362, by way of example. If the outer surface 296 of the tube is adjacent the inner end 360 of the peg 362, the peg abuts the outer surface, and the peg is not able to slide horizontally along its longitudinal axis into the tower. When the tube is pushed downwards by the tower top, the tube moves from an upper position shown in FIG. 18 to a lower position shown in FIG. 19, and the opening 358 aligns with the peg 362. When this happens, the peg slides inwardly under the influence of the weight of the stair 34. Sliding the peg inwardly allows the stair to collapse or pivot sufficiently to drop any unattached pawns resting on the stair. As illustrated, the peg 362 slides within a bushing 364.

Figure 20:
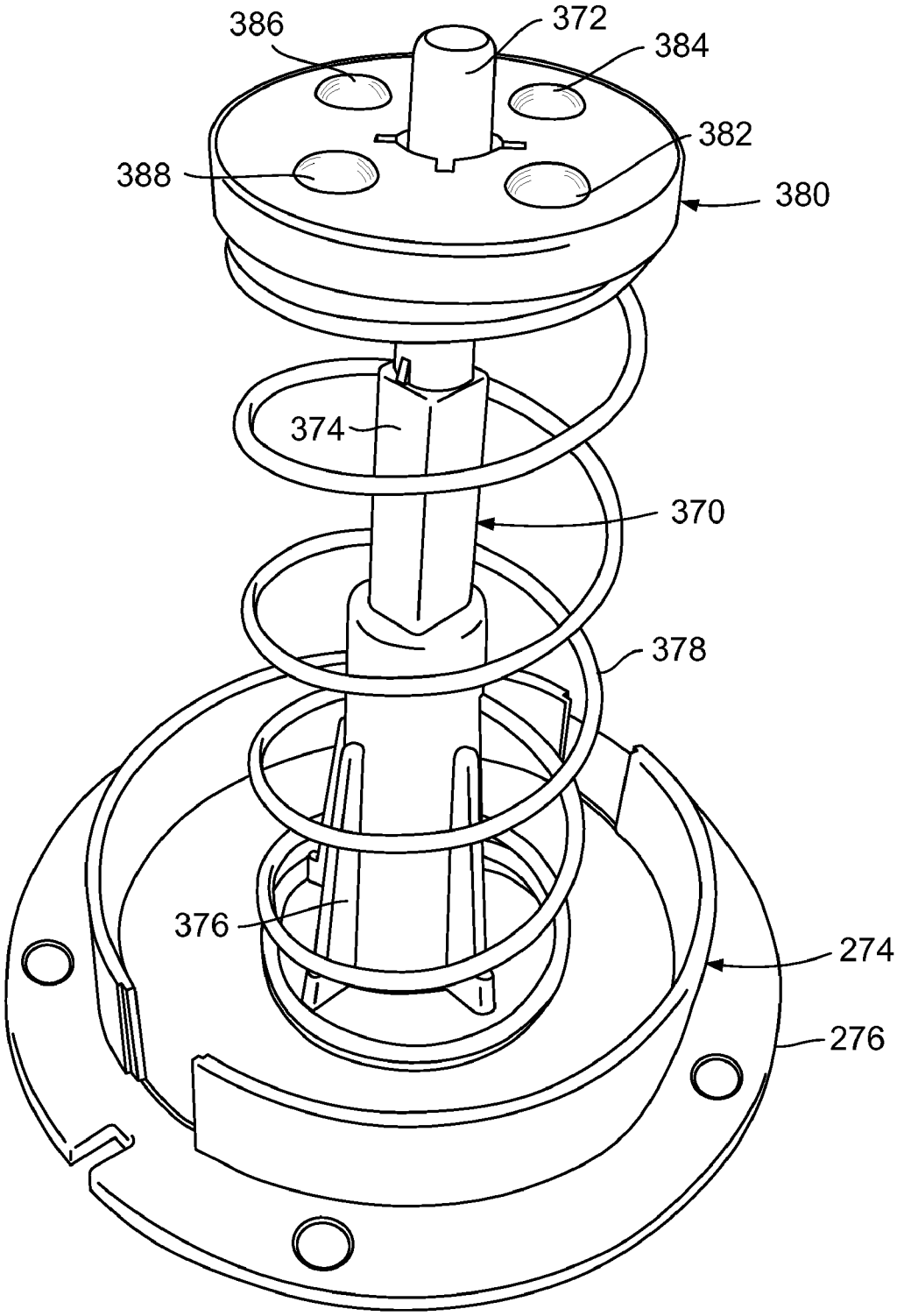
FIG. 20 is an enlarged isometric view of a spindle, a spring and part of a detent assembly.
Figure 21:
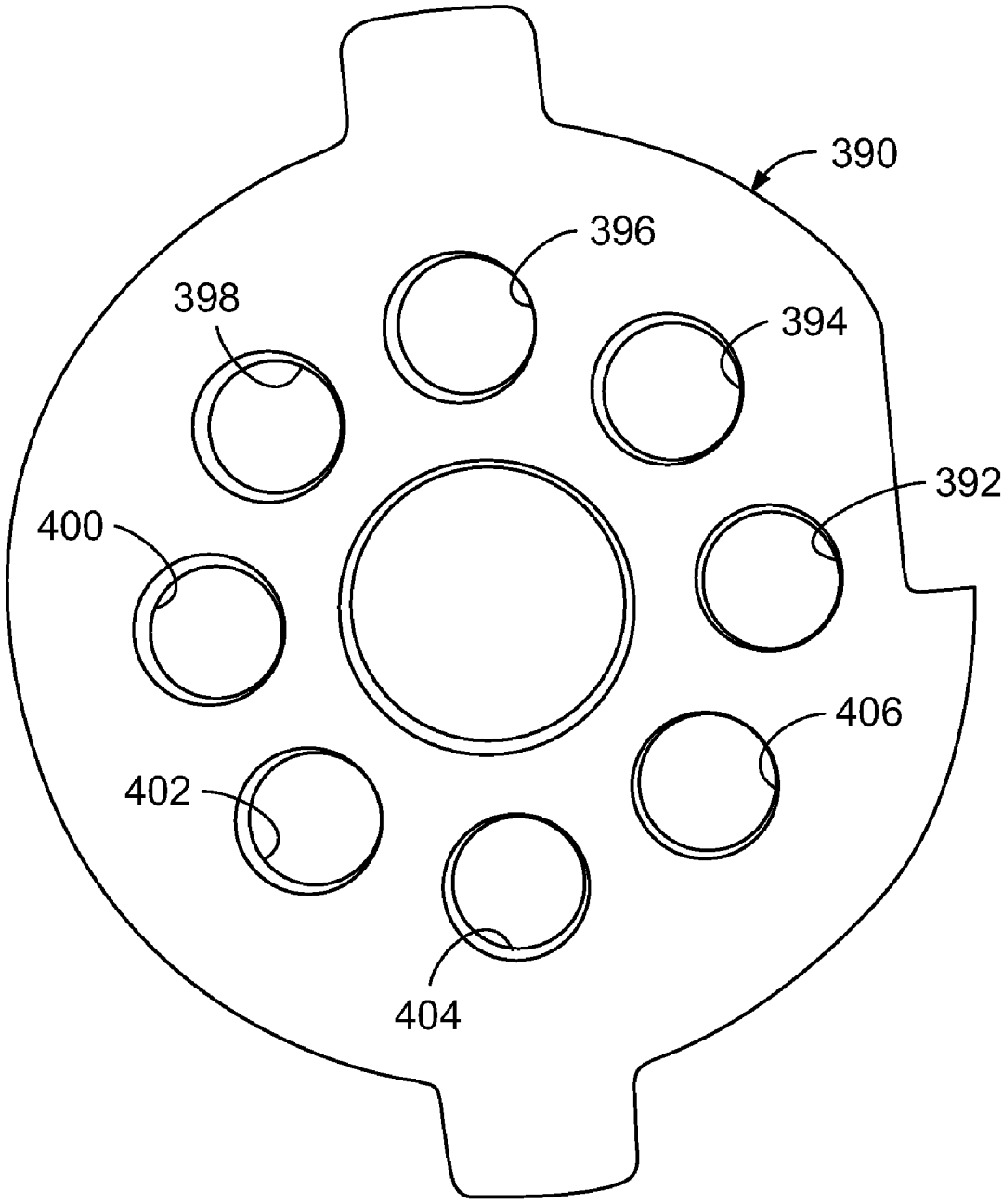
FIG. 21 is an enlarged plan view of an upper disk of the detent assembly.

Located within the tube 282, but formed as part of the bottom sleeve 274 is a spindle 370, FIGS. 12, 14 and 20, having three sections. An upper section 372 of the spindle is cylindrical in cross section, a middle section 374 has a square cross-section, and there is a reinforced lower section 376. Positioned around the spindle is a coiled spring 378. Mounted to the top of the spring is a lower disk 380 with four mounds or bumps 382, 384, 386, 388, FIG. 20, engaged with an upper disk 390, FIGS. 12, 14 and 21, having eight holes 392, 394, 396, 398, 400, 402, 404, 406 for receiving the four bumps. The lower disk 380 is stationary while the upper disk 390 is mounted to the tube 282 and is rotatable. The lower and upper disks 380, 390 are biased against one another by the spring 378, although the disks are still capable of relative rotation. Hence, the two disks 380, 390 act as a detent mechanism. The spring also permits the tube 282 to travel from the upper position, partially shown in FIG. 18, vertically downward to the lower position, partially shown in FIG. 19, in response to a depressive force applied by a player 73 onto the tower top as shown in FIG. 3. The spring is preloaded when the tower assembly is put together so that the disks are able to operate as a detent, however, the depressive force from a player compresses the spring still further, such that when the depressive force is released the spring is able to bias the tube back from the lower position to the upper position.

Each stair includes a pair of small shafts extending in opposite horizontal directions at an inner end portion of the stair, such as the left shaft 420, FIG. 1, of the stair 24 and the right shaft 422 of the stair 36. The small shafts enable engagement of the stairs with corresponding bracket pairs that have small holes, such as the hole 423, FIG. 18, in the bracket 425, to receive the shafts to facilitate rotation of the stairs. Each stair also includes a depending tab, such as the depending tab 424, FIGS. 18 and 19, near the horizontal shafts to engage an outer end of a peg, such as the outer end 426 of the peg 362. Each of the stairs is configured to connect to a pair of brackets at the stair's inner end such that unless supported, the stair will rotate or pivot downwardly due to it own weight, as illustrated in FIG. 19. This may be compared to FIG. 18, where the stair is illustrated in a peg supported horizontal position. Each of the pegs extends through the tower wall so as to be horizontally slideable.

Figure 22:
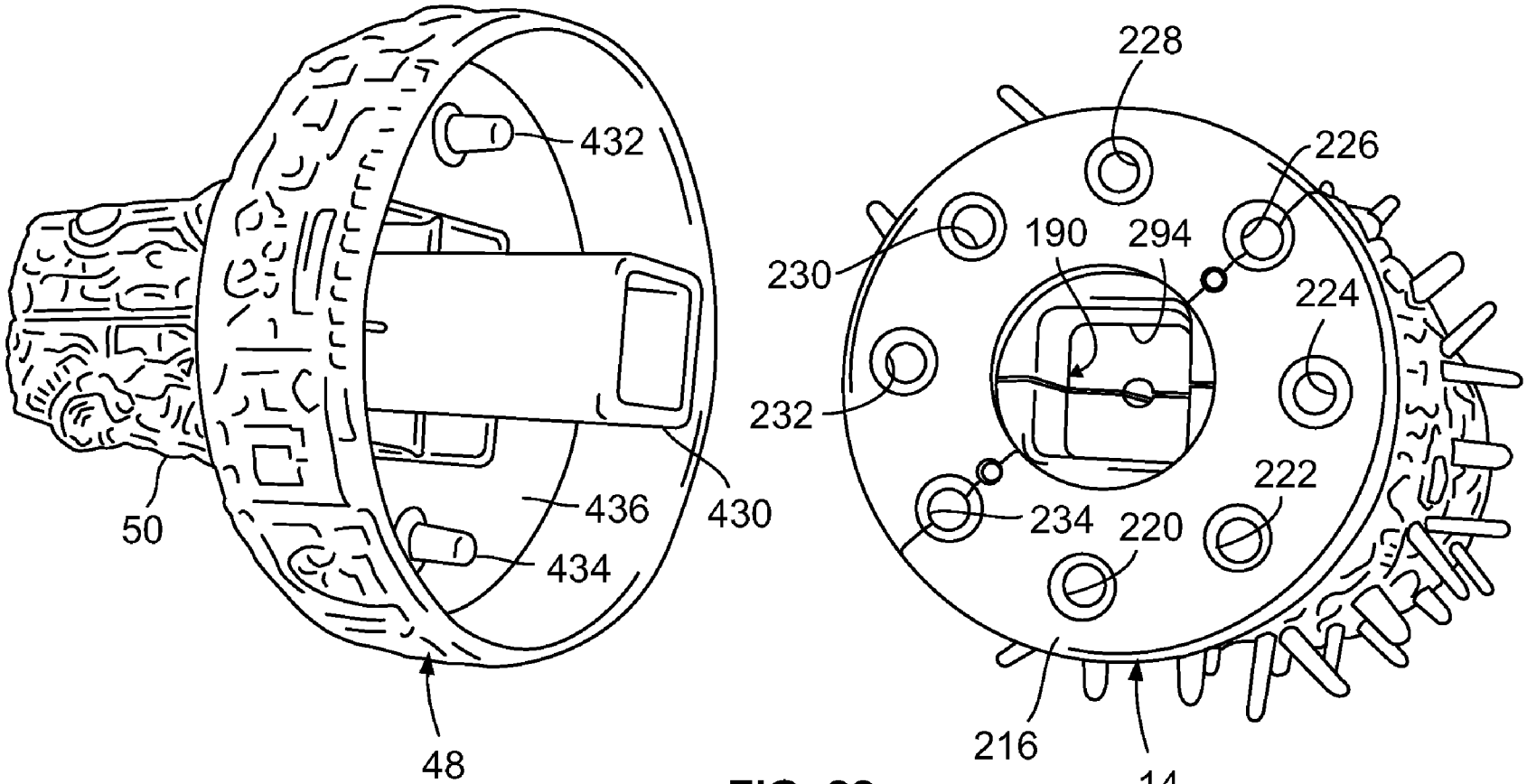
FIG. 22 is an isometric view of a bottom portion of a tower top and an isometric view of the tower looking downward, and illustrating the removal of the tower top from the tower.

Referring now to FIG. 22, the tower top 48 is illustrated removed from the tower 14 and turned over to reveal its underside. The underside of the tower top includes a central, square-shaped shaft 430 for receipt by the square shaped opening 294 in the top of the tube 282. The tower top also includes two alignment pins 432, 434 and a ring shaped wall 436. The square shaped shaft of the tower top enables a player rotating the tower top to also rotate the tube when instructed by a card. Depressing the tower top results in the shaft pushing the tube 282 downwardly against the spring 378. During depression of the tower top, the alignment pins 432, 434 of the tower top align with the holes 220, 222, 224, 226, 228, 230, 232, 234 in the top portion 216 of the tower 14 and the holes 246, 248, 250, 252, 254, 256, 258, 260 in the upper sleeve 242 to prevent rotation. The limit of depression is reached when the top portion 216 of the tower 14 abuts the ring shaped wall 436 of the tower top 48.

In operation during play, when a card instructs a player to turn the tower top, the player grips the upstanding shaft 50 and rotates the shaft once, twice or three times, as instructed. This rotation aligns the circumferential openings of the tube relative to the pegs in a fashion hidden from the players. When rotating the tower top, there is a tactile feel in the upstanding shaft 50 of the detent mechanism disengaging and then engaging, that is, during rotation the bumps of the lower disk 380 are removed from the holes of the upper disk 390 and then are reengaged with the holes after rotating forty-five degrees or one notch. The detent ensures alignment of the columns of tube openings with the pegs. When a card then instructs the player to push down on the tower top, the newly aligned tube will move axially downwardly against the spring, while being prevented from rotating, and align a column of circumferential openings in the outer surface with selective pegs. The result is that the selected pegs are pushed inwardly so as to enable the corresponding stairs to pivot downwardly and cause any pawns on those stairs to slide off and fall, unless the base of a pawn is connected to a hook, or the whip of the pawn is engaged to the tower through one of the tower whip openings. When the depressing force is released, the spring biases the tube upwardly thereby causing the outer surface of the tube to push against the pegs that slid inwardly. The tube causes the inwardly located pegs to move outwardly against the tabs integral with the collapsed stairs. The outward movement of the pegs causes the stairs to return to horizontal positions and the game goes on. Because the tower top must be rotated before being depressed, the next time a card instructs that the tower top is to be depressed, the tube will have been circumferentially moved to another column of openings so that the players will not know which stairs will collapse when the tower top is again depressed.

The tower, the tube, the base, the tower top, the stair, the pegs, the peg bushings, the dice and the disks may all be molded of a suitable plastic and either fastened or snapped together. The cards and base insert may be formed of a suitable paper. In the alternative, other suitable materials may be used. It may now be appreciated that the game apparatus is robust, relatively inexpensive and easily manipulated, even for children as young as age seven. Chance introduced by the dice, the cards and the rotation of the tube enhances the fun and excitement of play.

From the foregoing, it can be seen that there has been provided features and advantages for an improved board game assembly and game apparatus, as well as a method for playing the board game. While a particular embodiment of the present invention has been shown and described in detail, it will be obvious to those skilled in the art that changes and modifications may be made without departing from the invention in its broader aspects. Therefore, the aim here is to cover all such changes and modifications as fall within the true spirit and scope of the invention as expressed in the appended claims. The matters set forth in the foregoing description and accompanying drawings are offered by way of illustrations only and not as claim limitations. The actual scope of the invention is to be defined by the subsequent claims when viewed in their proper perspective based on the prior art.

What is claimed is:

1. A game assembly comprising:

a base;

an upstanding structure mounted to the base;

a plurality of outwardly extending structures mounted to the upstanding structure, each of the outwardly extending structures being movable relative to the upstanding structure;

a mechanism operator mounted to the upstanding structure for causing selective outwardly extending structures to move;

a movable structure connecting the mechanism operator and the outwardly extending structures;

a plurality of player pawns for selective movement along the outwardly extending structures;

chance structure for indicating how the player pawns are to be moved;

said outwardly extending structures being mounted around the upstanding structure in a spiral pattern and are pivotal relative to the upstanding structure;

selective outwardly extending structures include a protrusion for engaging the player pawns; and the upstanding structure includes openings in selected locations for engaging player pawns.

2. A game apparatus comprising:

a base;

a tower mounted to the base;

a vertically moveable tube mounted to the tower structure;

a plurality of stairs movably connected to and extending away from the tower; and operator structure mounted to the tower and in contact with the tube for moving the tube to cause selected stairs to pivot, wherein the tube is mounted within the tower, the tube including an outer surface with selectively spaced openings; and including links extending between the outer surface of the tube and the stairs to selectively support the stairs.

3. The apparatus of claim 2, wherein:

the operator structure selectively rotates and depresses the tube wherein depressing the tube pivots the selected stairs downwardly.

4. The apparatus of claim 3, wherein:

the tube is spring biased to return to an original position when a depressing force on the operator structure is released.

5. A game apparatus comprising:

a base;

a tower mounted to the base;

a vertically biased structure within the tower;

one or more outwardly extending structures coupled on the tower;

one or more downwardly extending structures coupled on the tower;

a plurality of player pawns for being located on said one or more outwardly extending structures;

a plurality of links extending from the vertically biased structure, one of the plurality of links for each of said one or more outwardly extending structures and one of the plurality of links for each of said one or more downwardly extending structures; and a player operated mechanism at the vertically biased structure arranged to support said one or more outwardly extending structures with one or more of said plurality of links.

6. The apparatus of claim 5, comprising a chance structure for indicating how the player pawns are to be located on said one or more outwardly extending structures.

7. The apparatus of claim 5, wherein said player operated mechanism at the vertically biased structure is arranged to selectively support said one or more downwardly extending structures with one or more of said plurality of links.

8. The apparatus of claim 5, further comprising one or more other player pawns arranged to fall from said one or more downwardly extending structures.

9. The apparatus of claim 5, wherein the player operated mechanism selectively depresses the vertically biased structure with a depressing force at the player operated mechanism.

10. The apparatus of claim 9, wherein the vertically biased structure is spring biased to return to an original position when the depressing force on the player operated mechanism is released.

11. The apparatus of claim 5, wherein the player operated mechanism selectively rotates the vertically biased structure.

12. The assembly of claim 5, wherein said upstanding structure includes openings in selected locations for engaging player pawns.

* * * * *